US008180082B2

(12) United States Patent
Takano et al.

(10) Patent No.: US 8,180,082 B2
(45) Date of Patent: May 15, 2012

(54) MICROPHONE UNIT, CLOSE-TALKING VOICE INPUT DEVICE, INFORMATION PROCESSING SYSTEM, AND METHOD OF MANUFACTURING MICROPHONE UNIT

(75) Inventors: Rikuo Takano, Tsukuba (JP); Kiyoshi Sugiyama, Mitaka (JP); Toshimi Fukuoka, Yokohama (JP); Masatoshi Ono, Tsukuba (JP); Ryusuke Horibe, Hirakata (JP); Fuminori Tanaka, Suita (JP); Hideki Choji, Muko (JP); Takeshi Inoda, Tsukuba (JP)

(73) Assignees: Funai Electric Advanced Applied Technology Research Institute Inc. (JP); Funai Electric Co., Ltd. (JP)

( * ) Notice: Subject to any disclaimer, the term of this patent is extended or adjusted under 35 U.S.C. 154(b) by 1050 days.

(21) Appl. No.: 12/080,579

(22) Filed: Apr. 3, 2008

(65) Prior Publication Data

US 2008/0247586 A1 Oct. 9, 2008

(30) Foreign Application Priority Data

Apr. 4, 2007 (JP) ..... 2007-98486
Mar. 27, 2008 (JP) ..... 2008-83294

(51) Int. Cl.
*H04R 25/00* (2006.01)
*H04R 1/02* (2006.01)

(52) U.S. Cl. ..... 381/322; 381/351

(58) Field of Classification Search ..... 381/189, 381/322, 337, 351; 438/53; 257/419, E29.324
See application file for complete search history.

(56) References Cited

U.S. PATENT DOCUMENTS 5,226,076 A * 7/1993 Baumhauer et al. ..... 379/420.02
7,602,931 B2 * 10/2009 Akino et al. ..... 381/355

FOREIGN PATENT DOCUMENTS

| | | | |
|---|---|---|---|
| CA | 2032080 | | 7/1996 |
| GB | 2218303 | A1 * | 3/1989 |
| GB | 2218303 | | 11/1989 |
| JP | 48-21519 | | 3/1973 |
| JP | 63-232798 | | 9/1988 |
| JP | 01-268398 | | 10/1989 |
| JP | 04-76795 | | 7/1992 |
| JP | 04-217199 | | 8/1992 |
| JP | 05-260580 | | 10/1993 |
| JP | 07-312638 | | 11/1995 |
| JP | 09-331377 | | 12/1997 |
| JP | 2001-186241 | | 7/2001 |
| JP | 2005-295278 | | 10/2005 |

* cited by examiner

*Primary Examiner* — Calvin Lee
(74) *Attorney, Agent, or Firm* — Harness, Dickey & Pierce, P.L.C.

(57) ABSTRACT

A microphone unit includes: a housing which has an inner space; a partition member which is provided in the housing and divides the inner space into a first space and a second space, the partition member being at least partially formed of a diaphragm; and an electrical signal output circuit which outputs an electrical signal based on vibrations of the diaphragm. In the housing, a first through-hole through which the first space communicates with an outer space of the housing and a second through-hole through which the second space communicates with the outer space are formed.

40 Claims, 24 Drawing Sheets

1kHz

Δr=5mm

MICROPHONE-SOUND SOURCE DISTANCE 2.5cm

MICROPHONE-SOUND SOURCE DISTANCE 1m

1kHz

Δr=10mm

MICROPHONE-SOUND SOURCE DISTANCE 2.5cm

MICROPHONE-SOUND SOURCE DISTANCE 1m

1kHz

Δr=20mm

MICROPHONE-SOUND SOURCE DISTANCE 2.5cm

MICROPHONE-SOUND SOURCE DISTANCE 1m

7kHz

Δr=5mm

MICROPHONE-SOUND SOURCE DISTANCE 2.5cm

MICROPHONE-SOUND SOURCE DISTANCE 1m

7kHz

Δr=10mm

MICROPHONE-SOUND SOURCE DISTANCE 2.5cm

MICROPHONE-SOUND SOURCE DISTANCE 1m

7kHz

Δr=20mm

MICROPHONE-SOUND SOURCE DISTANCE 2.5cm

MICROPHONE-SOUND SOURCE DISTANCE 1m

300Hz

Δr=5mm

MICROPHONE-SOUND SOURCE DISTANCE 2.5cm

MICROPHONE-SOUND SOURCE DISTANCE 1m

300Hz

Δr=10mm

MICROPHONE-SOUND SOURCE DISTANCE 2.5cm

MICROPHONE-SOUND SOURCE DISTANCE 1m

300Hz

Δr=20mm

MICROPHONE-SOUND SOURCE DISTANCE 2.5cm

MICROPHONE-SOUND SOURCE DISTANCE 1m

MICROPHONE UNIT, CLOSE-TALKING VOICE INPUT DEVICE, INFORMATION PROCESSING SYSTEM, AND METHOD OF MANUFACTURING MICROPHONE UNIT

Japanese Patent Application No. 2007-98486, filed on Apr. 4, 2007, and Japanese Patent Application No. 2008-83294, filed on Mar. 27, 2008, are hereby incorporated be reference in their entirety.

BACKGROUND OF THE INVENTION

The present invention relates to a microphone unit, a close-talking voice input device, an information processing system, and a method of manufacturing a microphone unit.

It is desirable to pick up only desired sound (user's voice) during a telephone call, speech recognition, voice recording, or the like. However, sound (e.g., background noise) other than desired sound may also be present in an environment in which a voice input device is used. Therefore, a voice input device has been developed which has a function of removing noise so that the user's voice can be accurately extracted even when the voice input device is used in an environment in which noise is present.

As technology which removes noise in an environment in which noise is present, a method which provides a microphone unit with sharp directivity, and a method which detects the travel direction of sound waves utilizing the difference in time when sound waves reach a microphone unit and removes noise by signal processing have been known.

In recent years, electronic instruments have been increasingly scaled down. Therefore, technology which reduces the size of a voice input device has become important (see JP-A-7-312638, JP-A-9-331377, and JP-A-2001-186241).

In order to provide a microphone unit with sharp directivity, it is necessary to arrange a number of diaphragms. This makes it difficult to reduce the size of a voice input device.

In order to detect the travel direction of sound waves utilizing the difference in time when sound waves reach a microphone unit, a plurality of diaphragms must be provided at intervals equal to a fraction of several wavelengths of an audible sound wave. This also makes it difficult to reduce the size of a voice input device.

SUMMARY

According to a first aspect of the invention, there is provided a microphone unit comprising:

a housing which has an inner space;

a partition member which is provided in the housing and divides the inner space into a first space and a second space, the partition member being at least partially formed of a diaphragm; and an electrical signal output circuit which outputs an electrical signal based on vibrations of the diaphragm, a first through-hole through which the first space communicates with an outer space of the housing and a second through-hole through which the second space communicates with the outer space being formed in the housing.

According to a second aspect of the invention, there is provided a close-talking voice input device comprising the above-described microphone unit.

According to a third aspect of the invention, there is provided an information processing system comprising:

the above-described microphone unit; and an analysis section which analyzes a voice which has entered the microphone unit based on the electrical signal.

According to a fourth aspect of the invention, there is provided a method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole through which the first space communicates with an outer space of the housing and a second through-hole through which the second space communicates with the outer space in the housing, wherein a center-to-center distance between the first through-hole and the second through-hole is set within a range in which a sound pressure when using the diaphragm as a differential microphone is equal to or less than a sound pressure when using the diaphragm as a single microphone with respect to sound in a frequency band of 10 kHz or less.

According to a fifth aspect of the invention, there is provided a method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole through which the first space communicates with an outer space of the housing and a second through-hole through which the second space communicates with the outer space in the housing, wherein a center-to-center distance between the first through-hole and the second through-hole is set within a range in which a sound pressure when using the diaphragm as a differential microphone is equal to or less than a sound pressure when using the diaphragm as a single microphone in all directions with respect to sound in an extraction target frequency band.

DETAILED DESCRIPTION OF THE EMBODIMENT

Figure 1:
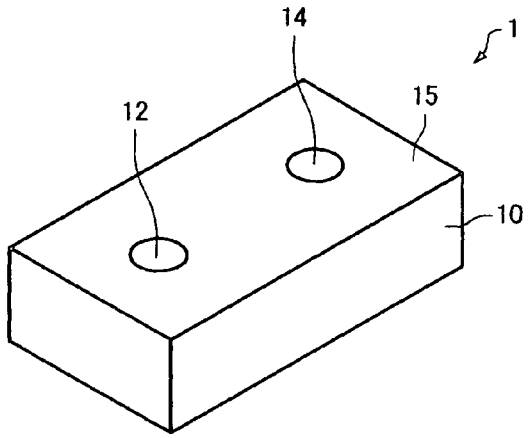
FIG. 1 is a diagram illustrative of a microphone unit.

The invention may provide a high-quality microphone unit which has a small external shape and can implement accurate noise removal, a method of manufacturing such a microphone unit, a close-talking voice input device using such a microphone unit, and an information processing system.

(1) According to one embodiment of the invention, there is provided a microphone unit comprising:

a housing which has an inner space;

a partition member which is provided in the housing and divides the inner space into a first space and a second space, the partition member being at least partially formed of a diaphragm; and an electrical signal output circuit which outputs an electrical signal based on vibrations of the diaphragm, a first through-hole through which the first space communicates with an outer space of the housing and a second through-hole through which the second space communicates with the outer space being formed in the housing.

According to this embodiment, a user's voice and noise are incident on each face of the diaphragm. Since a noise component incident on each face of the diaphragm has almost the same sound pressure, the noise components are canceled by the diaphragm. Therefore, the sound pressure which causes the diaphragm to vibrate may be considered to be a sound pressure which represents the user's voice, and an electrical signal obtained based on vibrations of the diaphragm may be considered to be an electrical signal which represents the user's voice from which noise has been removed.

According to this embodiment, a high-quality microphone unit which can implement accurate noise removal by a simple configuration can be provided.

(2) In this microphone unit, the partition member may be provided so that a medium that propagates sound waves does not move between the first space and the second space inside the housing.

(3) In this microphone unit, the housing may have a polyhedral external shape; and the first through-hole and the second through-hole may be formed in one face of the polyhedron.

In this microphone unit, the first through-hole and the second through-hole may be formed in a single face of a polyhedron. In other words, the first and second through-holes may be formed along an identical direction. Therefore, since the sound pressures of noise which enters the housing through the first and second through-holes can be made (almost) equal, noise can be removed with high accuracy.

(4) In this microphone unit, the diaphragm may be disposed so that a normal to the diaphragm is in parallel to the face.

(5) In this microphone unit, the diaphragm may be disposed so that a normal to the diaphragm perpendicularly intersects the face.

(6) In this microphone unit, the diaphragm may be disposed so that the diaphragm does not overlap the first through-hole or the second through-hole.

According to this configuration, even if foreign matter enters the inner space through the first and second through-holes, the diaphragm is rarely directly damaged by the foreign matter.

(7) In this microphone unit, the diaphragm may be disposed on a side of the first through-hole or the second through-hole.

(8) In this microphone unit, the diaphragm may be disposed so that a distance between the diaphragm and the first through-hole is not equal to a distance between the diaphragm and the second through-hole.

(9) In this microphone unit, the partition member may be disposed so that the first space and the second space have an identical volume.

(10) In this microphone unit, a center-to-center distance between the first through-hole and the second through-hole may be 5.2 mm or less.

(11) In this microphone unit, the electrical signal output circuit may be at least partially formed in the housing.

(12) In this microphone unit, the housing may have a shielding structure which electromagnetically separates the inner space and the outer space of the housing.

(13) In this microphone unit, the diaphragm may include a vibrator having an SN ratio of about 60 dB or more.

For example, the diaphragm may be formed of a vibrator having an SN ratio of 60 dB or more, or may be formed of a vibrator having an SN ratio of 60±α dB or more.

(14) In this microphone unit, a center-to-center distance between the first through-hole and the second through-hole may be set within a range in which a sound pressure when using the diaphragm as a differential microphone is equal to or less than a sound pressure when using the diaphragm as a single microphone with respect to sound in a frequency band of 10 kHz or less.

The first through-hole and the second through-hole may be disposed along a travel direction of sound (e.g., voice) from a sound source, and the center-to-center distance between the first through-hole and the second through-hole may be set within a range in which a sound pressure when using the diaphragm as a differential microphone is equal to or less than a sound pressure when using the diaphragm as a single microphone with respect to sound from the travel direction.

(15) In this microphone unit, a center-to-center distance between the first through-hole and the second through-hole may be set within a range in which a sound pressure when using the diaphragm as a differential microphone is equal to or less than a sound pressure when using the diaphragm as a single microphone in all directions with respect to sound in an extraction target frequency band.

The term "extraction target frequency" refers to the frequency of sound to be extracted by using the microphone. For example, the center-to-center distance between the first through-hole and the second through-hole may be set using a frequency of 7 kHz or less as the extraction target frequency

(16) According to one embodiment of the invention, there is provided, a close-talking voice input device comprising the above-described microphone unit.

According to this voice input device, an electrical signal which represents a user's voice from which noise has been accurately removed can be obtained. According to this embodiment, a voice input device can be provided which enables highly accurate speech recognition, voice authentication, or command generation based on an input voice.

(17) In this voice input device, the housing may have a polyhedral external shape; and the first through-hole and the second through-hole may be formed in one face of the polyhedron.

(18) In this voice input device, a center-to-center distance between the first through-hole and the second through-hole may be 5.2 mm or less.

(19) In this voice input device, the diaphragm may include a vibrator having an SN ratio of about 60 dB or more.

For example, the diaphragm may be formed of a vibrator having an SN ratio of 60 dB or more, or may be formed of a vibrator having an SN ratio of 60±α dB or more.

(20) In this voice input device, a center-to-center distance between the first through-hole and the second through-hole may be set within a range in which a sound pressure when using the diaphragm as a differential microphone is equal to or less than a sound pressure when using the diaphragm as a single microphone with respect to sound in a frequency band of 10 kHz or less.

The first through-hole and the second through-hole may be disposed along a travel direction of sound (e.g., voice) from a sound source, and the center-to-center distance between the first through-hole and the second through-hole may be set within a range in which a sound pressure when using the diaphragm as a differential microphone is equal to or less than a sound pressure when using the diaphragm as a single microphone with respect to sound from the travel direction.

(21) In this voice input device, a center-to-center distance between the first through-hole and the second through-hole may be set within a range in which a sound pressure when using the diaphragm as a differential microphone is equal to or less than a sound pressure when using the diaphragm as a single microphone in all directions with respect to sound in an extraction target frequency band.

The term "extraction target frequency" refers to the frequency of sound to be extracted using the microphone. For example, the center-to-center distance between the first through-hole and the second through-hole may be set using a frequency of 7 kHz or less as the extraction target frequency.

(22) According to one embodiment of the invention, there is provided an information processing system comprising:

the above-described microphone unit; and an analysis section which analyzes a voice which has entered the microphone unit based on the electrical signal.

According to this information processing system, an electrical signal which represents a user's voice from which noise has been accurately removed can be obtained. According to this embodiment, an information processing system which enables highly accurate voice analysis can be provided.

(23) According to one embodiment of the invention, there is provided, a method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole through which the first space communicates with an outer space of the housing and a second through-hole through which the second space communicates with the outer space in the housing, wherein a center-to-center distance between the first through-hole and the second through-hole is set within a range in which a sound pressure when using the diaphragm as a differential microphone is equal to or less than a sound pressure when using the diaphragm as a single microphone with respect to sound in a frequency band of 10 kHz or less.

The first through-hole and the second through-hole may be disposed along a travel direction of sound (e.g., voice) from a sound source, and the center-to-center distance between the first through-hole and the second through-hole may be set within a range in which a sound pressure when using the diaphragm as a differential microphone is equal to or less than a sound pressure when using the diaphragm as a single microphone with respect to sound from the travel direction.

(24) According to one embodiment of the invention, there is provided, a method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole through which the first space communicates with an outer space of the housing and a second through-hole through which the second space communicates with the outer space in the housing, wherein a center-to-center distance between the first through-hole and the second through-hole is set within a range in which a sound pressure when using the diaphragm as a differential microphone is equal to or less than a sound pressure when using the diaphragm as a single microphone in all directions with respect to sound in an extraction target frequency band.

The term "extraction target frequency" refers to the frequency of sound to be extracted by using the microphone. It may be 7 kHz or less.

Some embodiments of the invention will be described below, with reference to the drawings. Note that the invention is not limited to the following embodiments. The invention includes configuration in which the elements in the following description are arbitrarily combined.

1. Configuration of Microphone Unit 1

The configuration of a microphone unit 1 according to one embodiment of the invention is described below.

Figure 2A:
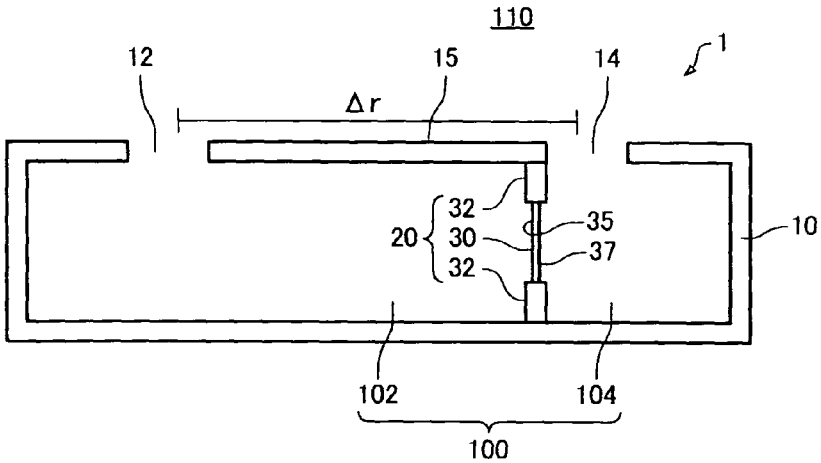
FIGS. 2A and 2B are diagrams illustrative of a microphone unit.

As shown in FIGS. 1 and 2A, the microphone unit 1 according to this embodiment includes a housing 10. The housing 10 is a member which defines the external shape of the microphone unit 1. The housing 10 (microphone unit 1) may have a polyhedral external shape. As shown in FIG. 1, the housing 10 may have a hexahedral (rectangular parallelepiped or cube) external shape. Note that the housing 10 may have a polyhedral external shape other than a hexahedron. The housing 10 may have an external shape (e.g., sphere (hemisphere)) other than a polyhedron.

As shown in FIG. 2A, the housing 10 has an inner space 100 (first and second spaces 102 and 104). Specifically, the housing 10 has a structure which defines a specific space. The inner space 100 is a space defined by the housing 10. The housing 10 may have a shielding structure (electromagnetic shielding structure) which electrically and magnetically separates the inner space 100 and a space (outer space 110) outside the housing 10. This ensures that a diaphragm 30 and an electric signal output circuit 40 described later are rarely affected by an electronic component disposed outside the housing 10 (outer space 110), whereby a microphone unit which can implement a highly accurate noise removal function can be provided.

As shown in FIGS. 1 and 2A, a through-hole through which the inner space 100 of the housing 10 communicates with the outer space 110 is formed in the housing 10. In this embodiment, a first through-hole 12 and a second through-hole 14 are formed in the housing 10. The first through-hole 12 is a through-hole through which the first space 102 communicates with the outer space 110. The second through-hole 14 is a through-hole through which the second space 104 communicates with the outer space 110. The details of the first and second spaces 102 and 104 are described later. The shape of the first and second through-holes 12 and 14 is not particularly limited. As shown in FIG. 1, the first and second through-holes 12 and 14 may have a circular shape, for example. Note that the first and second through-holes 12 and 14 may have a shape (e.g., rectangle) other than a circle.

In this embodiment, the first and second through-holes 12 and 14 are formed in one face 15 of the housing 10 having a hexahedral structure (polyhedral structure), as shown in FIGS. 1 and 2A. As a modification, the first and second through-holes 12 and 14 may be formed in different faces of a polyhedron. For example, the first and second through-holes 12 and 14 may be formed in opposite faces of a hexahedron, or may be formed in adjacent faces of a hexahedron. In this embodiment, one first through-hole 12 and one second through-hole 14 are formed in the housing 10. Note that the invention is not limited thereto. A plurality of first through-holes 12 and a plurality of second through-holes 14 may be formed in the housing 10.

Figure 2B:
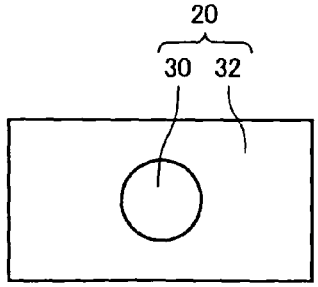

As shown in FIGS. 2A and 2B, the microphone unit 1 according to this embodiment includes a partition member 20. FIG. 2B is a front view showing the partition member 20. The partition member 20 is provided in the housing 10 to divide the inner space 100. In this embodiment, the partition member 20 is provided to divide the inner space 100 into the first and second spaces 102 and 104. Specifically, the first and second spaces 102 and 104 are defined by the housing 10 and the partition member 20.

The partition member 20 may be provided so that a medium that propagates sound waves does not (cannot) move between the first and second spaces 102 and 104 inside the housing 10. For example, the partition member 20 may be an airtight partition wall that airtightly divides the inner space 100 (first space 102 and second space 104) inside the housing 10.

As shown in FIGS. 2A and 2B, the partition member 20 is at least partially formed of the diaphragm 30. The diaphragm 30 is a member that vibrates in the normal direction when sound waves are incident on the diaphragm 30. The microphone unit 1 extracts an electrical signal based on vibrations of the diaphragm 30 to obtain an electrical signal which represents sound incident on the diaphragm 30. Specifically, the diaphragm 30 may be a diaphragm of a microphone (electro-acoustic transducer that converts an acoustic signal into an electrical signal).

Figure 3:
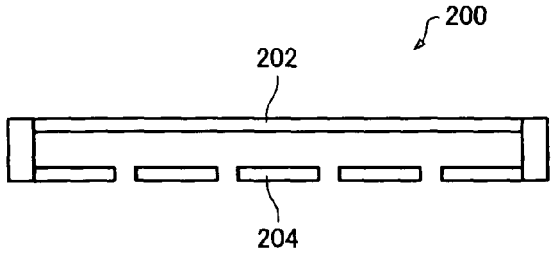
FIG. 3 is a diagram illustrative of a microphone unit.

The configuration of a capacitor-type microphone 200 is described below as an example of a microphone which may be applied to this embodiment. FIG. 3 is a diagram illustrative of the capacitor-type microphone 200.

The capacitor-type microphone 200 includes a diaphragm 202. The diaphragm 202 corresponds to the diaphragm 30 of the microphone unit 1 according to this embodiment. The diaphragm 202 is a film (thin film) that vibrates in response to sound waves. The diaphragm 202 has conductivity and forms one electrode. The capacitor-type microphone 200 includes an electrode 204. The electrode 204 is disposed opposite to the diaphragm 202. The diaphragm 202 and the electrode 204 thus form a capacitor. When sound waves enter the capacitor-type microphone 200, the diaphragm 202 vibrates so that the distance between the diaphragm 202 and the electrode 204 changes, whereby the capacitance between the diaphragm 202 and the electrode 204 changes. An electrical signal based on vibrations of the diaphragm 202 can be obtained by acquiring the change in capacitance as a change in voltage, for example. Specifically, sound waves entering the capacitor-type microphone 200 can be converted into and output as an electrical signal. In the capacitor-type microphone 200, the electrode 204 may have a structure which prevents the effect of sound waves. For example, the electrode 204 may have a mesh structure.

The microphone (diaphragm 30) which may be applied to the invention is not limited to the capacitor-type microphone. A known microphone may be applied to the invention. For example, the diaphragm 30 may be a diaphragm of an electrokinetic (dynamic) microphone, an electromagnetic (magnetic) microphone, a piezoelectric (crystal) microphone, or the like.

The diaphragm 30 may be a semiconductor film (e.g., silicon film). Specifically, the diaphragm 30 may be a diaphragm of a silicon microphone (Si microphone). A reduction in size and an increase in performance of the microphone unit 1 can be achieved utilizing a silicon microphone.

The external shape of the diaphragm 30 is not particularly limited. As shown in FIG. 2B, the diaphragm 30 may have a circular external shape. In this case, the diaphragm 30 and the first and second through-holes 12 and 14 may be circular and have (almost) the same diameter. The diaphragm 30 may be larger or smaller than the first and second through-holes 12 and 14. The diaphragm 30 has first and second faces 35 and 37. The first face 35 faces the first space 102, and the second face 37 faces the second space 104.

In this embodiment, the diaphragm 30 may be provided so that the normal to the diaphragm 30 extends parallel to the face 15 of the housing 10, as shown in FIG. 2A. In other words, the diaphragm 30 may be provided to perpendicularly intersect the face 15. The diaphragm 30 may be disposed on the side of (near) the second through-hole 14. Specifically, the diaphragm 30 may be disposed so that the distance between the diaphragm 30 and the first through-hole 12 is not equal to the distance between the diaphragm 30 and the second through-hole 14. As a modification, the diaphragm 30 may be disposed midway between the first and second through-holes 12 and 14 (not shown).

In this embodiment, the partition member 20 may include a holding portion 32 which holds the diaphragm 30, as shown in FIGS. 2A and 2B. The holding portion 32 may adhere to the inner wall surface of the housing 10. The first and second spaces 102 and 104 can be airtightly separated by causing the holding portion 32 to adhere to the inner wall surface of the housing 10.

The microphone unit 1 according to this embodiment includes an electrical signal output circuit 40 which outputs an electrical signal based on vibrations of the diaphragm 30. The electrical signal output circuit 40 may be at least partially formed in the inner space 100 of the housing 10. The electrical signal output circuit 40 may be formed on the inner wall surface of the housing 10, for example. Specifically, the housing 10 according to this embodiment may be utilized as a circuit board of an electrical circuit.

Figure 4:
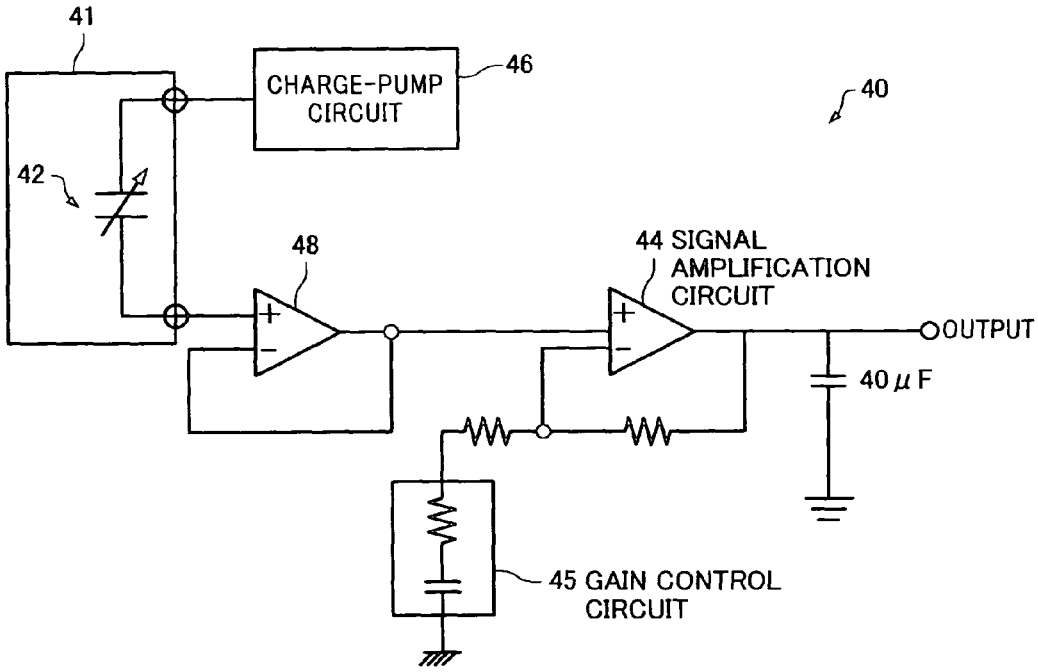
FIG. 4 is a diagram illustrative of a microphone unit.

FIG. 4 shows an example of the electrical signal output circuit 40 which may be applied to this embodiment. The electrical signal output circuit 40 may amplify an electrical signal based on a change in capacitance of a capacitor 42 (capacitor-type microphone having the diaphragm 30) using a signal amplification circuit 44, and output the amplified signal. The capacitor 42 may form part of a diaphragm unit 41, for example. The electrical signal output circuit 40 may include a charge-pump circuit 46 and an operational amplifier 48. This makes it possible to accurately detect (acquire) a change in capacitance of the capacitor 42. In this embodiment, the capacitor 42, the signal amplification circuit 44, the charge-pump circuit 46, and the operational amplifier 48 may be formed on the inner wall surface of the housing 10, for example. The electrical signal output circuit 40 may include a gain control circuit 45. The gain control circuit 45 adjusts the amplification factor (gain) of the signal amplification circuit 44. The gain control circuit 45 may be provided inside or outside the housing 10.

When applying a diaphragm of a silicon microphone as the diaphragm 30, the electrical signal output circuit 40 may be implemented by an integrated circuit formed on a semiconductor substrate of the silicon microphone.

The electrical signal output circuit 40 may further include a conversion circuit which converts an analog signal into a digital signal, a compression circuit which compresses (encodes) a digital signal, and the like.

The diaphragm may include a vibrator having an SN (Signal to Noise) ratio of about 60 dB or more. When making the vibrator function as a differential microphone, the SN ratio decreases in comparison with the case that the vibrator is made to function as a single microphone. Consequently, by using a vibrator having an improved SN ratio (a MEMS vibrator having an SN ratio of about 60 dB or more, for example), a sensitive microphone unit can be implemented.

For example, when the speaker-microphone distance is about 2.5 cm (this is close-talking microphone unit) and a single microphone is used as a differential microphone, the sensitivity decreases by a dozen dB. However, by using a vibrator having an SN ratio of about 60 dB or more to provide the diaphragm, a microphone unit having enough functions necessary for a microphone can be implemented in spite of the influence of decrease of an SN ratio.

The microphone unit 1 according to this embodiment may be configured as described above. The microphone unit 1 can implement a highly accurate noise removal function by a simple configuration. The noise removal principle of the microphone unit 1 is described below.

2. Noise Removal Principle of Microphone Unit 1

(1) Configuration of Microphone Unit 1 and Vibration Principle of Diaphragm 30

The vibration principle of the diaphragm 30 derived from the configuration of the microphone unit 1 is as follows.

In this embodiment, a sound pressure is applied to each face (first and second faces 35 and 37) of the diaphragm 30. When the same amount of sound pressure is simultaneously applied to each face of the diaphragm 30, the sound pressures are cancelled through the diaphragm 30 and do not cause the diaphragm 30 to vibrate. In other words, when sound pressures which differ in amount are applied to the respective faces of the diaphragm 30, the diaphragm 30 vibrates due to the difference in sound pressure.

The sound pressures of sound waves which have entered the first and second through-holes 12 and 14 are evenly transmitted to the inner wall surfaces of the first and second spaces 102 and 104 (Pascal's law). Therefore, a sound pressure equal to the sound pressure which has entered the first through-hole 12 is applied to the face (first face 35) of the diaphragm 30 which faces the first space 102, and a sound pressure equal to the sound pressure which has entered the second through-hole 14 is applied to the face (second face 37) of the diaphragm 30 which faces the second space 104.

Specifically, the sound pressures applied to the first and second faces 35 and 37 correspond to the sound pressures of sounds which have entered the first and second through-holes 12 and 14, respectively. The diaphragm 30 vibrates due to the difference between the sound pressures of sound waves respectively incident on the first and second faces 35 and 37 (first and second through-holes 12 and 14).

(2) Properties of Sound Waves

Figure 5:
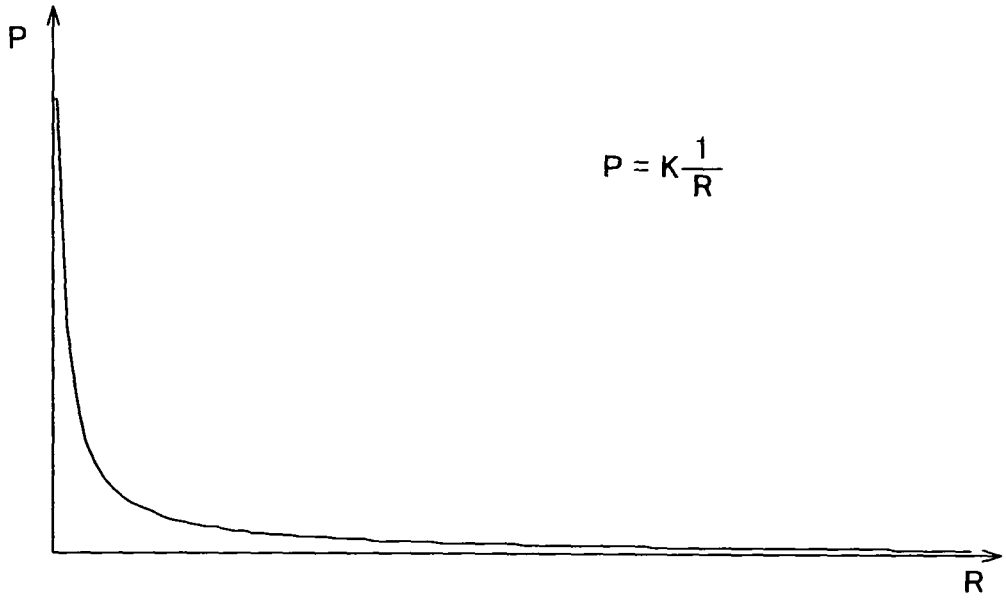
FIG. 5 is a graph illustrative of attenuation characteristics of sound waves.

Sound waves are attenuated during travel through a medium so that the sound pressure (intensity/amplitude of sound waves) decreases. Since a sound pressure is in inverse proportion to the distance from a sound source, a sound pressure P is expressed by the following expression with respect to the relationship with a distance R from a sound source, $$P = K\frac{1}{R} \tag{1}$$

where, k is a proportional constant. FIG. 5 shows a graph of the expression (1). As shown in FIG. 5, the sound pressure (amplitude of sound waves) is rapidly attenuated at a position near the sound source (left of the graph), and is gently attenuated as the distance from the sound source increases.

When applying the microphone unit 1 to a close-talking voice input device, the user speaks near the microphone unit 1 (first and second through-holes 12 and 14). Therefore, the user's voice is attenuated to a large extent between the first and second through-holes 12 and 14 so that the sound pressure of the user's voice which enters the first through-hole 12 (i.e., the sound pressure of the user's voice incident on the first face 35) differs to a large extent from the sound pressure of the user's voice which enters the second through-hole 14 (i.e., the user's voice incident on the second face 37).

On the other hand, the sound source of a noise component is situated at a position away from the microphone unit 1 (first and second through-holes 12 and 14) as compared with the user's voice. Therefore, the sound pressure of noise is attenuated to only a small extent between the first and second through-holes 12 and 14 so that the sound pressure of noise which enters the first through-hole 12 differs to only a small extent from the sound pressure of noise which enters the second through-hole 14.

(3) Noise Removal Principle

The diaphragm 30 vibrates due to the difference between the sound pressures of sound waves which are simultaneously incident on the first and second faces 35 and 37, as described above. Since the difference between the sound pressure of noise incident on the first face 35 and the sound pressure of noise incident on the second face 37 is very small, the noise is canceled by the diaphragm 30. On the other hand, since the difference between the sound pressure of the user's voice incident on the first face 35 and the sound pressure of the user's voice incident on the second face 37 is large, the user's voice is not canceled by the diaphragm 30 and causes the diaphragm 30 to vibrate.

According to the microphone unit 1, it is considered that the diaphragm 30 vibrates due to only the user's voice. Therefore, an electrical signal output from the microphone unit 1 (electrical signal output circuit 40) is considered to be a signal which represents only the user's voice from which noise has been removed.

Specifically, the microphone unit 1 according to this embodiment enables a voice input device to be provided which can obtain an electrical signal which represents a user's voice from which noise has been removed by a simple configuration.

3. Conditions Whereby Noise Removal Function with Higher Accuracy is Implemented Using Microphone Unit 1

As described above, the microphone unit 1 can produce an electrical signal which represents only a user's voice from which noise has been removed. However, sound waves contain a phase component. Therefore, conditions whereby a noise removal function with higher accuracy can be implemented (design conditions for the microphone unit 1) can be derived utilizing the phase difference between sound waves which enter the first through-hole 12 (first face 35 of the diaphragm 30) and sound waves which enter the second through-hole 14 (second face 37 of the diaphragm 30). The conditions which should be satisfied by the microphone unit 1 in order to implement a noise removal function with higher accuracy are described below.

According to the microphone unit 1, a signal output based on the sound pressure which causes the diaphragm 30 to vibrate (i.e., the difference between the sound pressure applied to the first face 35 and the sound pressure applied to the second face 37; hereinafter appropriately referred to as "differential sound pressure") is considered to be a signal which represents a user's voice, as described above. According to the microphone unit 1, it may be considered that the noise removal function has been implemented when a noise component included in the sound pressure (differential sound pressure) which causes the diaphragm 30 to vibrate has been reduced as compared with a noise component included in the sound pressure incident on the first face 35 or the second face 37. Specifically, it may be considered that the noise removal function has been implemented when a noise intensity ratio which indicates the ratio of the intensity of a noise component included in the differential sound pressure to the intensity of a noise component included in the sound pressure incident on the first face 35 or the second face 37 has become smaller than a user's voice intensity ratio which indicates the ratio of the intensity of a user's voice component included in the differential sound pressure to the intensity of a user's voice component included in the sound pressure incident on the first face 35 or the second face 37.

Specific conditions which should be satisfied by the microphone unit 1 (housing 10) in order to implement the noise removal function are described below.

The sound pressures of a user's voice incident on the first and second faces 35 and 37 of the diaphragm 30 (first and second through-holes 12 and 14) are discussed below. When the distance from the sound source of a user's voice to the first through-hole 12 is referred to as R and the center-to-center distance between the first and second through-holes 12 and 14 is referred to as Δr, the sound pressures (intensities) P(S1) and P(S2) of the user's voice which enters the first and second through-holes 12 and 14 are expressed as follows when disregarding the phase difference.

$$\begin{cases} P(S1) = K\dfrac{1}{R} & (2) \\ P(S2) = K\dfrac{1}{R+\Delta r} & (3) \end{cases}$$

Therefore, a user's voice intensity ratio ρ(P) which indicates the ratio of the sound pressure of the user's voice incident on the first face 35 (first through-hole 12) to the intensity of a user's voice component included in the differential sound pressure is expressed as follows when disregarding the phase difference of the user's voice.

$$\rho(P) = \frac{P(S1) - P(S2)}{P(S1)} = \frac{\Delta r}{R + \Delta r} \tag{4}$$

When the microphone unit 1 is utilized for a close-talking voice input device, the center-to-center distance Δr is considered to be sufficiently smaller than the distance R.

Therefore, the expression (4) can be transformed as follows.

$$\rho(P) = \frac{\Delta r}{R} \tag{A}$$

Specifically, the user's voice intensity ratio when disregarding the phase difference of the user's voice is expressed by the above expression (A).

The sound pressures Q(S1) and Q(S2) of the user's voice are expressed as follows when taking the phase difference of the user's voice into consideration, $$\begin{cases} Q(S1) = K\frac{1}{R}\sin\omega t & (5) \\ Q(S2) = K\frac{1}{R+\Delta r}\sin(\omega t - \alpha) & (6) \end{cases}$$

where, α is the phase difference.

The user's voice intensity ratio ρ(S) is then:

$$\rho(S) = \frac{|P(S1) - P(S2)|_{max}}{|P(S1)|_{max}} = \frac{\left|\frac{K}{R}\sin\omega t - \frac{K}{R+\Delta r}\sin(\omega t - \alpha)\right|_{max}}{\left|\frac{K}{R}\sin\omega t\right|_{max}} \tag{7}$$

The user's voice intensity ratio ρ(S) may then be expressed as follows based on the expression (7).

$$\begin{aligned} \rho(S) &= \frac{\frac{K}{R}\left|\sin\omega t - \frac{1}{1+\Delta r/R}\sin(\omega t - \alpha)\right|_{max}}{\frac{K}{R}|\sin\omega t|_{max}} \\ &= \frac{1}{1+\Delta r/R}|(1+\Delta r/R)\sin\omega t - \sin(\omega t - \alpha)|_{max} \\ &= \frac{1}{1+\Delta r/R}\left|\sin\omega t - \sin(\omega t - \alpha) + \frac{\Delta r}{R}\sin\omega t\right|_{max} \end{aligned} \tag{8}$$

In the expression (8), the term sin ωt−sin(ωt−α) indicates the phase component intensity ratio, and the term Δr/R sin ωt indicates the amplitude component intensity ratio. Since the phase difference component as the user's voice component serves as noise for the amplitude component, the phase component intensity ratio must be sufficiently smaller than the amplitude component intensity ratio in order to accurately extract the user's voice. Specifically, it is important that sin ωt−sin(ωt−α) and Δr/R sin ωt satisfy the following relationship.

$$\left|\frac{\Delta r}{R}\sin\omega t\right|_{max} > |\sin\omega t - \sin(\omega t - \alpha)|_{max} \tag{B}$$

Since sin ωt−sin(ωt−α) is expressed as follows, $$\sin\omega t - \sin(\omega t - \alpha) = 2\sin\frac{\alpha}{2}\cdot\cos\left(\omega t - \frac{\alpha}{2}\right) \tag{9}$$

the expression (B) may then be expressed as follows.

$$\left|\frac{\Delta r}{R}\sin\omega t\right|_{max} > \left|2\sin\frac{\alpha}{2}\cdot\cos\left(\omega t - \frac{\alpha}{2}\right)\right|_{max} \tag{10}$$

Taking the amplitude component in the expression (10) into consideration, the microphone unit 1 according to this embodiment must satisfy the following expression.

$$\frac{\Delta r}{R} > 2\sin\frac{\alpha}{2} \tag{C}$$

Since the center-to-center distance Δr is considered to be sufficiently smaller than the distance R, as described above, sin(α/2) can be considered to be sufficiently small and approximated as follows.

$$\sin\frac{\alpha}{2} \approx \frac{\alpha}{2} \tag{11}$$

Therefore, the expression (C) can be transformed as follows.

$$\frac{\Delta r}{R} > \alpha \tag{D}$$

When the relationship between the phase difference α and the center-to-center distance Δr is expressed as follows, $$\alpha = \frac{2\pi\Delta r}{\lambda} \tag{12}$$

the expression (D) can be transformed as follows.

$$\frac{\Delta r}{R} > 2\pi\frac{\Delta r}{\lambda} > \frac{\Delta r}{\lambda} \tag{E}$$

Specifically, the user's voice can be accurately extracted when the microphone unit 1 according to this embodiment satisfies the relationship shown by the expression (E).

The sound pressures of noise incident on the first and second faces 35 and 37 (first and second through-holes 12 and 14) are discussed below.

When the amplitudes of noise components incident on the first and second faces 35 and 37 are referred to as A and A', sound pressures Q(N1) and Q(N2) of the noise are expressed as follows when taking a phase difference component into consideration.

$$\begin{cases} Q(N1) = A\sin\omega t & (13) \\ Q(N2) = A'\sin(\omega t - \alpha) & (14) \end{cases}$$

A noise intensity ratio ρ(N) which indicates the ratio of the sound pressure of a noise component incident on the first face 35 (first through-hole 12) to the intensity of a noise component included in the differential sound pressure is expressed as follows.

$$\rho(N) = \frac{|Q(N1) - Q(N2)|_{max}}{|Q(N1|_{max}} = \frac{|A\sin\omega t - A'\sin(\omega t - \alpha)|_{max}}{|A\sin\omega t|_{max}} \quad (15)$$

The amplitudes (intensities) of noise components incident on the first and second faces 35 and 37 (first and second through-holes 12 and 14) are almost the same (i.e., A=A'), as described above. Therefore, the expression (15) can be transformed as follows.

$$\rho(N) = \frac{|\sin\omega t - \sin(\omega t - \alpha)|_{max}}{|\sin\omega t|_{max}} \quad (16)$$

The noise intensity ratio is expressed as follows.

$$\rho(N) = \frac{|\sin\omega t - \sin(\omega t - \alpha)|_{max}}{|\sin\omega t|_{max}} = |\sin\omega t - \sin(\omega t - \alpha)|_{max} \quad (17)$$

The expression (17) can be transformed as follows based on the expression (9).

$$\rho(N) = \left|\cos\left(\omega t - \frac{\alpha}{2}\right)\right|_{max} \cdot 2\sin\frac{\alpha}{2} = 2\sin\frac{\alpha}{2} \quad (18)$$

The expression (18) can be transformed as follows based on the expression (11).

$$\rho(N)=\alpha \quad (19)$$

The noise intensity ratio is expressed as follows based on the expression (D).

$$\rho(N) = \alpha < \frac{\Delta r}{R} \quad (F)$$

Δr/R indicates the amplitude component intensity ratio of the user's voice, as indicated by the expression (A). In the microphone unit 1, the noise intensity ratio is smaller than the intensity ratio Δr/R of the user's voice, as is clear from the expression (F).

According to the microphone unit 1 (refer to the expression (B)) in which the phase component intensity ratio of the user's voice is smaller than the amplitude component intensity ratio, the noise intensity ratio is smaller than the user's voice intensity ratio (refer to the expression (F)). In other words, the microphone unit 1 designed so that the noise intensity ratio becomes smaller than the user's voice intensity ratio can implement a highly accurate noise removal function.

4. Method of Producing Microphone Unit 1

A method of producing the microphone unit 1 according to this embodiment is described below. In this embodiment, the microphone unit 1 may be produced utilizing the relationship between a ratio Δr/λ which indicates the ratio of the center-to-center distance Δr between the first and second through-holes 12 and 14 to a wavelength λ of noise and the noise intensity ratio (intensity ratio based on the phase component of noise).

The intensity ratio based on the phase component of noise is expressed by the expression (18). Therefore, the decibel value of the intensity ratio based on the phase component of noise is expressed as follows.

$$20\log\rho(N) = 20\log\left|2\sin\frac{\alpha}{2}\right| \quad (20)$$

Figure 6:
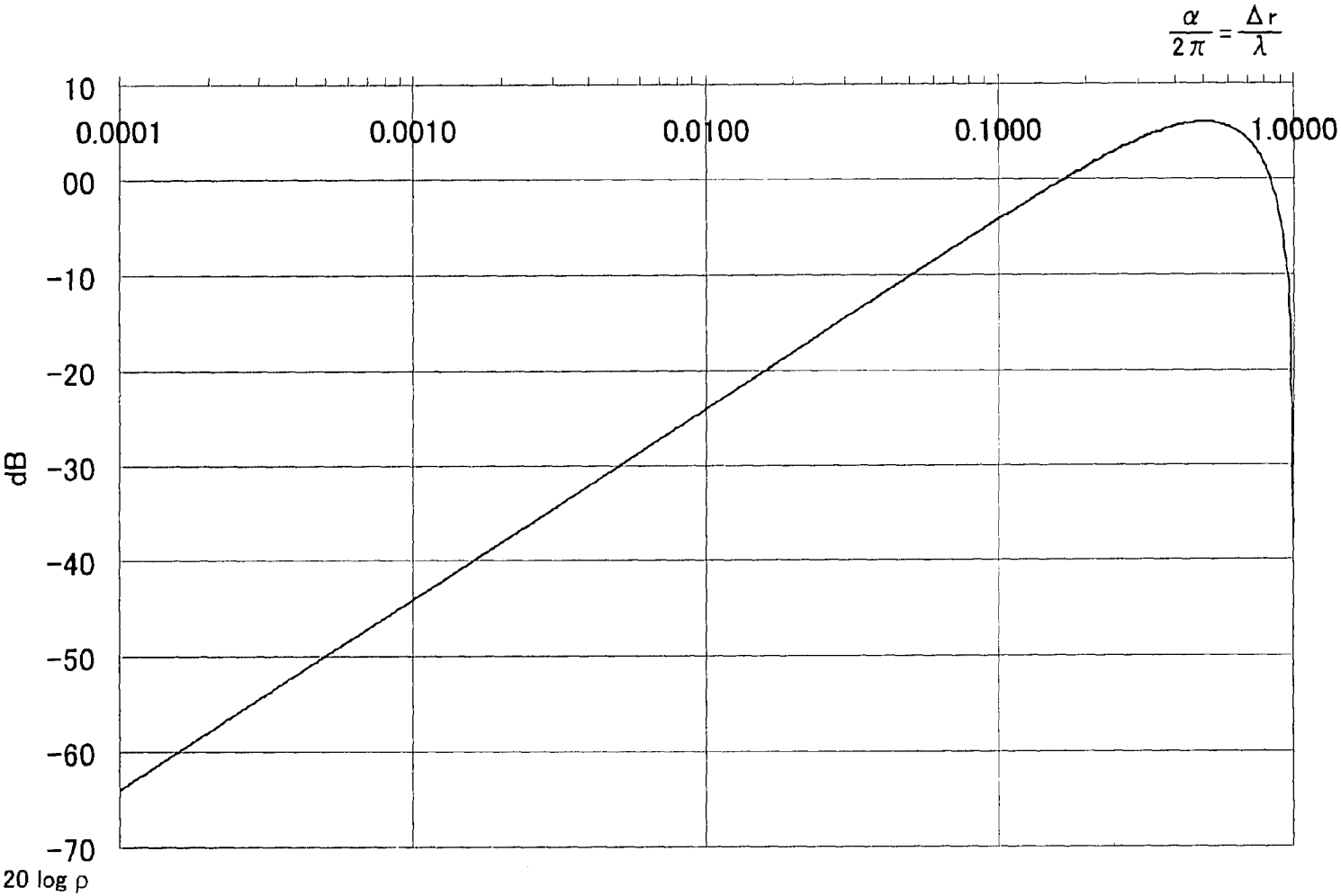
FIG. 6 is a graph showing an example of data which indicates the relationship between a phase difference and an intensity ratio.

The relationship between the phase difference α and the intensity ratio based on the phase component of noise can be determined by substituting each value for α in the expression (20). FIG. 6 shows an example of data which indicates the relationship between the phase difference and the intensity ratio wherein the horizontal axis indicates α/2π and the vertical axis indicates the intensity ratio (decibel value) based on the phase component of noise.

The phase difference α can be expressed as a function of the ratio Δr/λ which indicates the ratio of the distance Δr to the wavelength λ, as indicated by the expression (A). Therefore, the vertical axis in FIG. 6 is considered to indicate the ratio Δr/λ. Specifically, FIG. 6 shows data which indicates the relationship between the intensity ratio based on the phase component of noise and the ratio Δr/λ.

Figure 7:
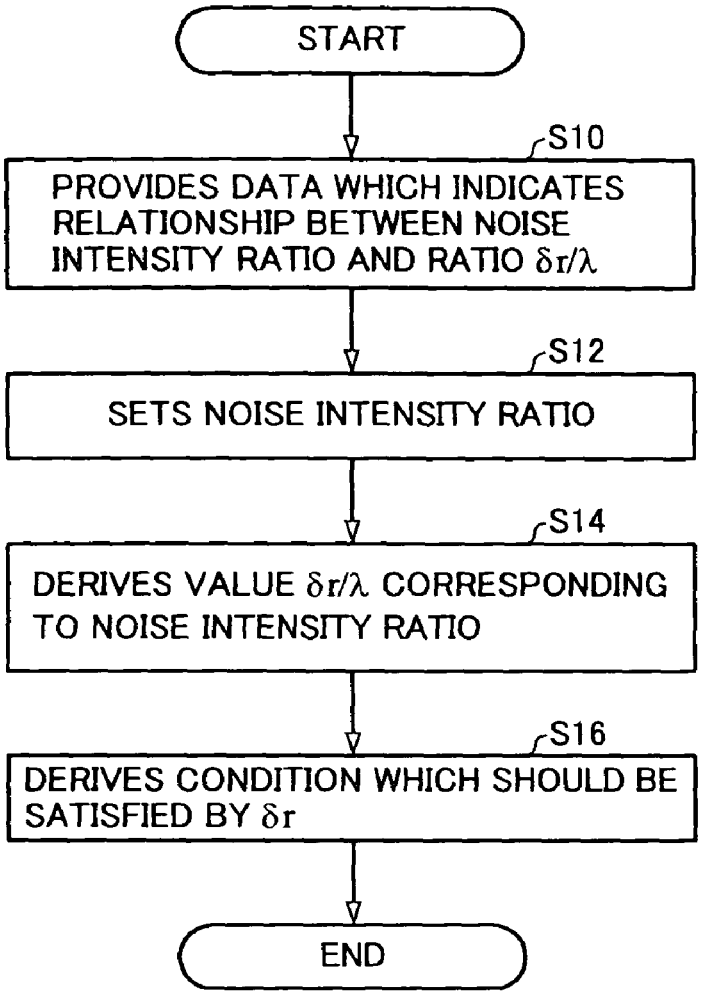
FIG. 7 is a flowchart showing a process of producing a microphone unit.

In this embodiment, the microphone unit 1 is produced utilizing the data shown in FIG. 6. FIG. 7 is a flowchart illustrative of the process of producing the microphone unit 1 utilizing the data shown in FIG. 6.

First, data which indicates the relationship between the noise intensity ratio (intensity ratio based on the phase component of noise) and the ratio Δr/λ (refer to FIG. 6) is provided (step S10).

The noise intensity ratio is set depending on the application (step S12). In this embodiment, the noise intensity ratio must be set so that the intensity of noise decreases. Therefore, the noise intensity ratio is set to be 0 dB or less in this step.

A value Δr/λ corresponding to the noise intensity ratio is derived based on the data (step S14).

A condition which should be satisfied by the distance Δr is derived by substituting the wavelength of the main noise for λ (step S16).

As a specific example, consider a case where the frequency of the main noise is 1 KHz and the microphone unit 1 which reduces the intensity of the noise by 20 dB is produced in an environment in which the wavelength of the noise is 0.347 m.

A condition whereby the noise intensity ratio becomes 0 dB or less is as follows. As shown in FIG. 6, the noise intensity ratio can be set at 0 dB or less by setting the value Δr/λ, at 0.16 or less. Specifically, the noise intensity ratio can be set at 0 dB or less by setting the distance Δr at 55.46 mm or less. This is a necessary condition for the microphone unit 1 (housing 10).

A condition whereby the intensity of noise having a frequency of 1 KHz is reduced by 20 dB is as follows. As shown in FIG. 6, the intensity of noise can be reduced by 20 dB by setting the value Δr/λ at 0.015. When λ=0.347 m, this condition is satisfied when the distance Δr is 5.199 mm or less.

Specifically, a microphone unit having a noise removal function can be produced by setting the distance Δr at about 5.2 mm or less.

When utilizing the microphone unit 1 according to this embodiment for a close-talking voice input device, the distance between the sound source of a user's voice and the microphone unit 1 (first and second through-holes 12 and 14) is normally 5 cm or less. The distance between the sound source of a user's voice and the microphone unit 1 (first and second through-holes 12 and 14) can be set by changing the design of the housing which receives the microphone unit 1. Therefore, the user's voice intensity ratio Δr/R becomes larger than 0.1 (noise intensity ratio), whereby the noise removal function is implemented.

Noise is not normally limited to a single frequency. However, since the wavelength of noise having a frequency lower than that of noise considered to the main noise is longer than that of the main noise, the value Δr/λ decreases, whereby the noise is removed by the microphone unit 1. The energy of sound waves is attenuated more quickly as the frequency becomes higher. Therefore, since the wavelength of noise having a frequency higher than that of noise considered to be the main noise is attenuated more quickly than the main noise, the effect of the noise on the microphone unit 1 (diaphragm 30) can be disregarded. Therefore, the microphone unit 1 according to this embodiment exhibits an excellent noise removal function even in an environment in which noise having a frequency differing from that of noise considered to the main noise is present.

This embodiment has been described taking an example in which noise enters the first and second through-holes 12 and 14 along a straight line which connects the first and second through-holes 12 and 14, as is clear from the expression (12). In this case, the apparent distance between the first and second through-holes 12 and 14 becomes a maximum, and the noise has the largest phase difference in the actual environment. Specifically, the microphone unit 1 according to this embodiment can remove noise having the largest phase difference. Therefore, the microphone unit 1 according to this embodiment can remove noise incident from all directions.

5. Effects

A summary of the effects of the microphone unit 1 is given below.

As described above, the microphone unit 1 can produce an electrical signal which represents a voice from which noise has been removed by merely acquiring an electrical signal which represents vibrations of the diaphragm 30 (electrical signal based on vibrations of the diaphragm 30). Specifically, the microphone unit 1 can implement a noise removal function without performing a complex analytical calculation process. Therefore, a high-quality microphone unit which can implement accurate noise removal by a simple configuration can be provided. In particular, a microphone unit which can implement a more accurate noise removal function can be provided by setting the center-to-center distance Δr between the first and second through-holes 12 and 14 at 5.2 mm or less.

A center-to-center distance between the first through-hole and the second through-hole may be set within a range in which a sound pressure when using the diaphragm as a differential microphone is equal to or less than a sound pressure when using the diaphragm as a single microphone with respect to sound in a frequency band of 10 kHz or less.

The first through-hole and the second through-hole may be disposed along a travel direction of sound (e.g., voice) from a sound source, and the center-to-center distance between the first through-hole and the second through-hole may be set within a range in which a sound pressure when using the diaphragm as a differential microphone is equal to or less than a sound pressure when using the diaphragm as a single microphone with respect to sound from the travel direction.

Figure 22:
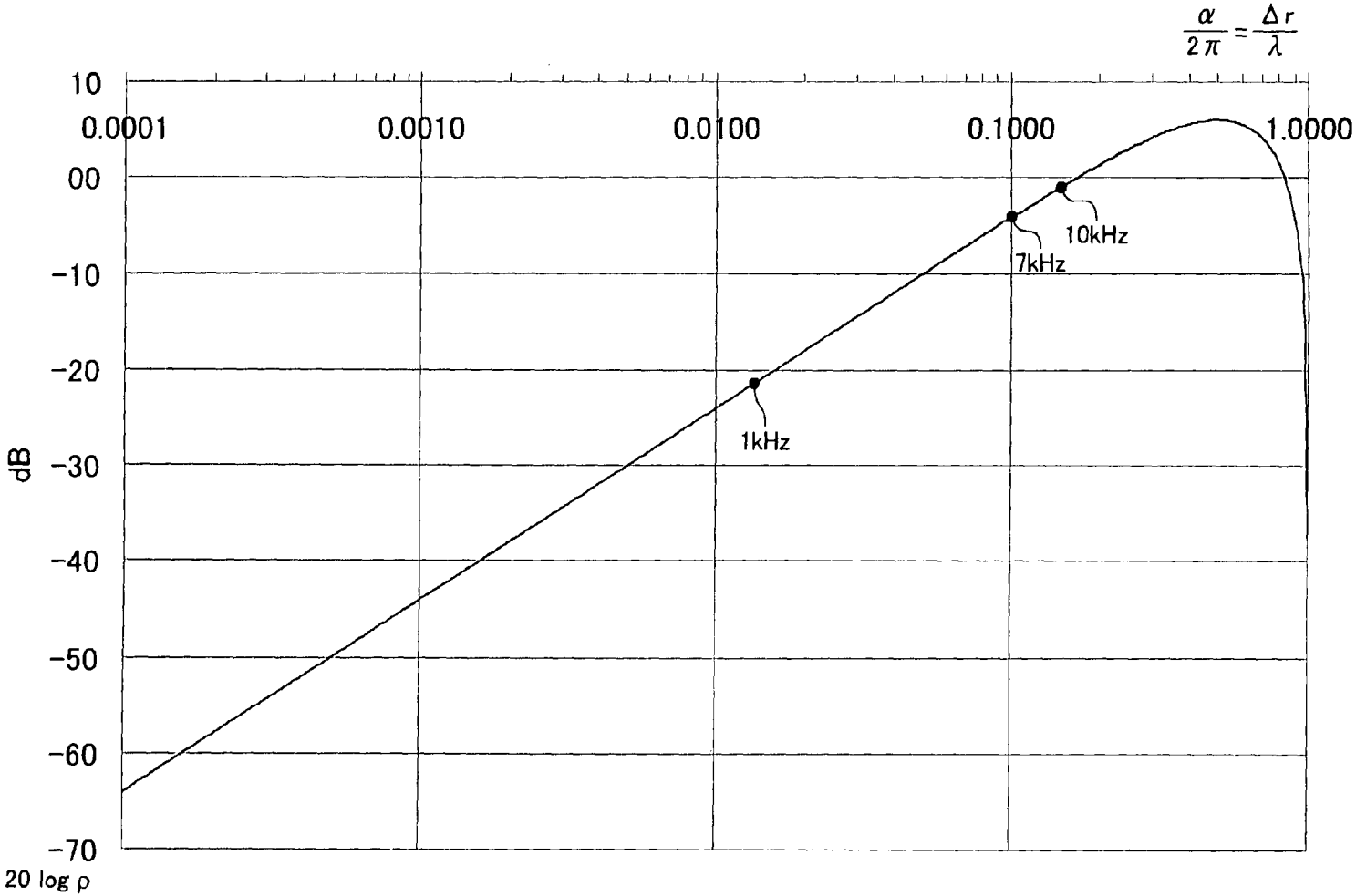
FIG. 22 is a graph for describing the distribution of a voice intensity ratio ρ when the microphone-microphone distance is 5 mm.
Figure 23:
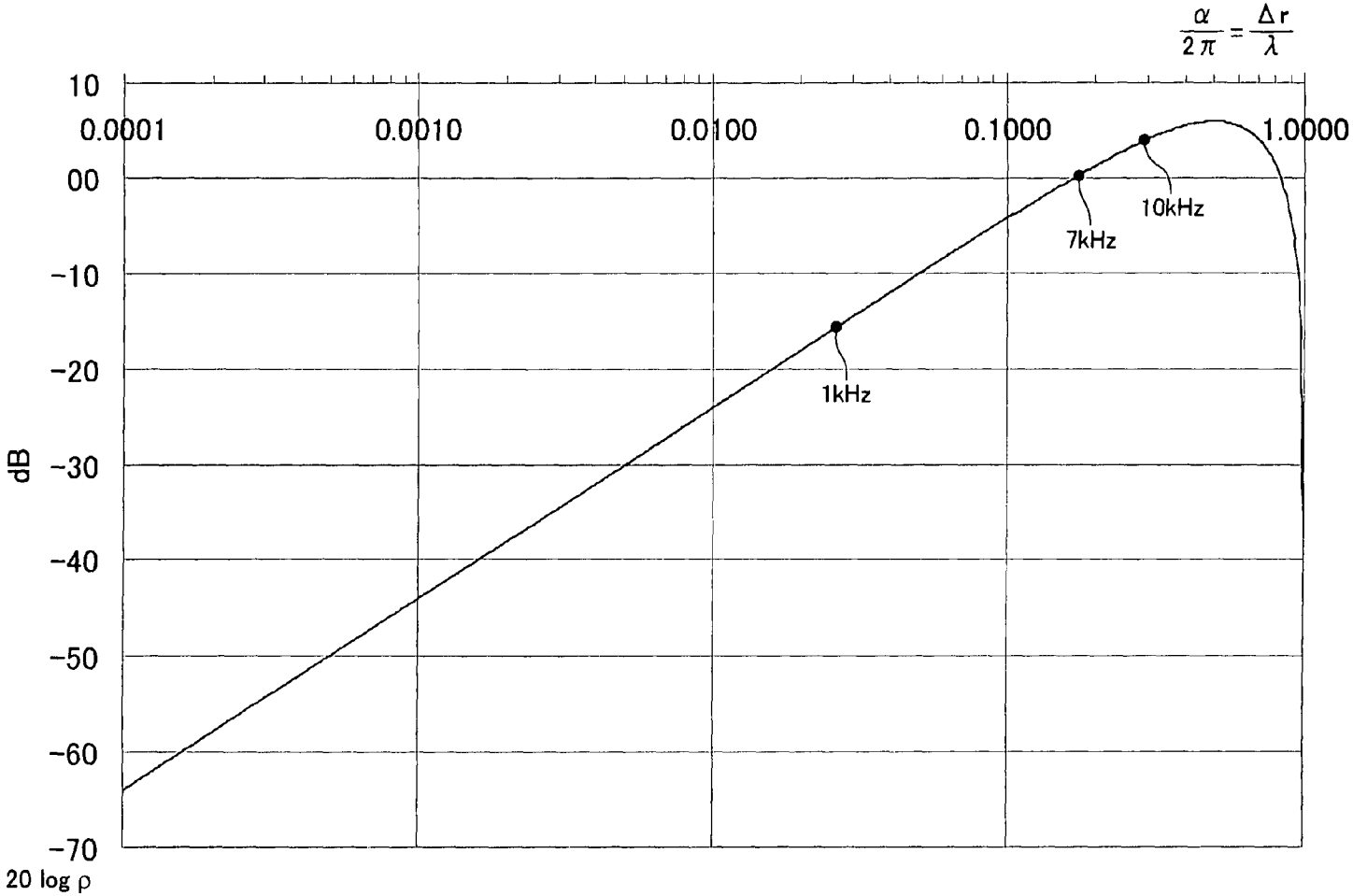
FIG. 23 is a graph for describing the distribution of a voice intensity ratio ρ when the microphone-microphone distance is 10 mm.
Figure 24:
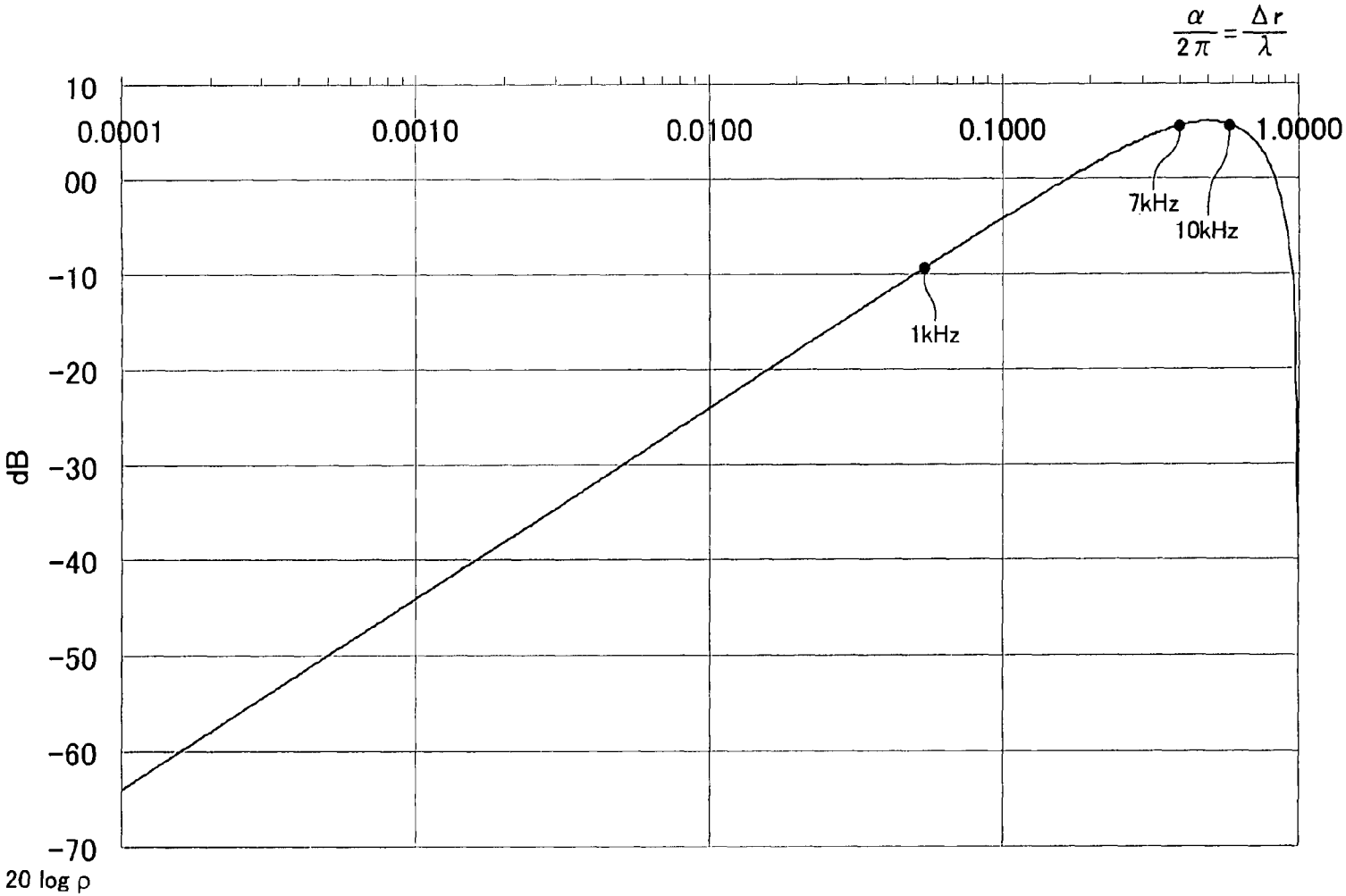
FIG. 24 is a graph for describing the distribution of a voice intensity ratio ρ when the microphone-microphone distance is 20 mm.

FIGS. 22 to 24 are diagrams illustrative of the relationship between the microphone-microphone distance and a voice intensity ratio ρ. In FIGS. 22 to 24, the horizontal axis indicates the ratio Δr/λ, and the vertical axis indicates a voice intensity ratio ρ. The term "voice intensity ratio ρ" refers to a sound pressure ratio of a differential microphone and a single microphone. A point at which the sound pressure when using the microphone forming the differential microphone as a single microphone is equal to the differential sound pressure is 0 dB.

Specifically, the graphs shown in FIGS. 22 to 24 indicate a change in differential sound pressure corresponding to the ratio Δr/λ. It is considered that a delay distortion (noise) occurs to a large extent in the area equal to or higher than 0 dB.

The current telephone line is designed for a voice frequency band of 3.4 kHz, but a voice frequency band of 7 kHz or more, or preferably of 10 kHz is required for a higher-quality voice communication. Influence of delay distortion for a voice frequency band of 10 kHz will be considered below.

FIG. 22 shows the distribution of a voice intensity ratio ρ when collecting sound at a frequency of 1 kHz, 7 kHz, or 10 kHz using the differential microphone when the microphone-microphone distance (Δr) is 5 mm.

As shown in FIG. 22, when the microphone-microphone distance is 5 mm, the voice intensity ratio ρ of sound at a frequency of 1 kHz, 7 kHz, or 10 kHz is equal to or less than 0 dB.

FIG. 23 shows the distribution of a voice intensity ratio ρ when collecting sound at a frequency of 1 kHz, 7 kHz, or 10 kHz using the differential microphone when the microphone-microphone distance (Δr) is 10 mm.

As shown in FIG. 23, when the microphone-microphone distance is 10 mm, the voice intensity ratio ρ of sound at a frequency of 1 kHz or 7 kHz is equal to or less than 0 dB. However, the voice intensity ratio ρ of sound at a frequency of 10 kHz is equal to or higher than 0 dB so that a delay distortion (noise) increases.

FIG. 24 shows the distribution of a voice intensity ratio ρ when collecting sound at a frequency of 1 kHz, 7 kHz, or 10 kHz using the differential microphone when the microphone-microphone distance (Δr) is 20 mm.

As shown in FIG. 24, when the microphone-microphone distance is 20 mm, the voice intensity ratio ρ of sound at a frequency of 1 kHz is equal to or less than 0 dB. However, the voice intensity ratio ρ of sound at a frequency of 7 kHz or 10 kHz is equal to or higher than 0 dB so that a delay distortion (noise) increases.

Therefore, a microphone which can accurately extract speech sound up to a 10 kHz frequency band and can significantly suppress distant noise can be implemented by setting the microphone-microphone distance at about 5 mm to about 6 mm (5.2 mm or less in detail).

In this embodiment, a microphone which can accurately extract speech sound up to a 10 kHz frequency band and can significantly suppress distant noise can be implemented by setting the center-to-center distance between the first and second through-holes 12 and 14 at about 5 mm to about 6 mm (5.2 mm or less in detail).

According to the microphone unit 1, the housing 10 (i.e., the positions of the first and second through-holes 12 and 14) can be designed so that noise which enters the housing 10 so that the noise intensity ratio based on the phase difference becomes a maximum can be removed. Therefore, the microphone unit 1 can remove noise incident from all directions. According to the invention, a microphone unit which can remove noise incident from all directions can be provided.

FIGS. 25A and 25B to FIGS. 31A and 31B are diagrams illustrative of the directivity of the differential microphone with respect to the frequency band, the microphone-microphone distance, and the microphone-sound source distance.

Figure 25A:
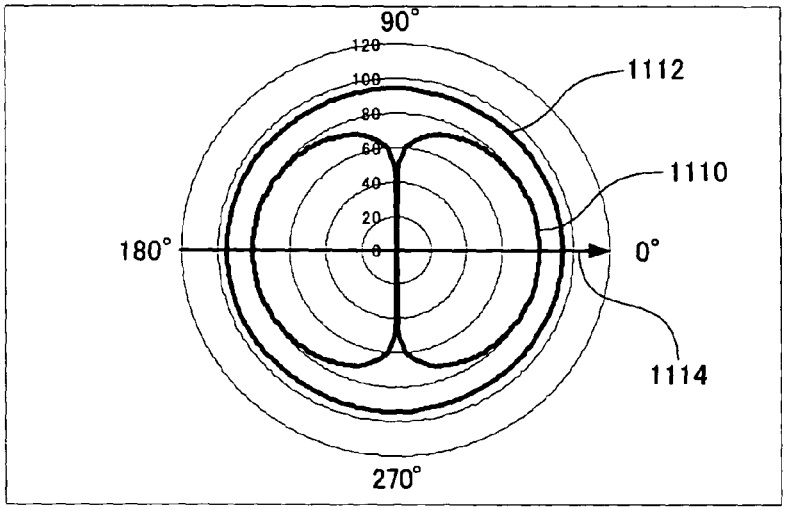
FIGS. 25A and 25B are diagrams illustrative of the directivity of a differential microphone when a microphone-microphone distance is 5 mm, a frequency band is 1 kHz, and a microphone-sound source distance is 2.5 cm or 1 m.
Figure 25B:
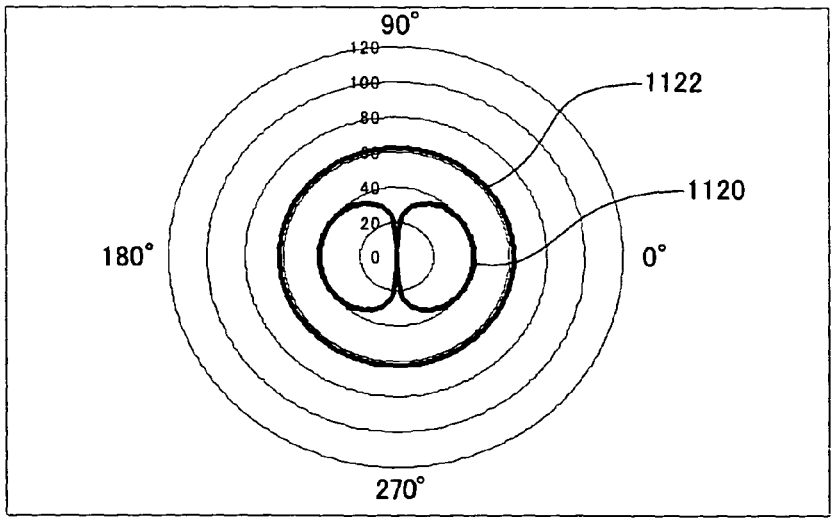

FIGS. 25A and 25B are diagrams showing the directivity of the differential microphone when the frequency band of the sound source is 1 kHz, the microphone-microphone distance is 5 mm, the microphone-sound source distance is 2.5 cm (corresponding to the close-talking distance between the mouth of the speaker and the microphone) or 1 m (corresponding to distant noise).

A reference numeral 1110 indicates a graph showing the sensitivity (differential sound pressure) of the differential microphone in all directions (i.e., the directional pattern of the differential microphone). A reference numeral 1112 indicates a graph showing the sensitivity (differential sound pressure) in all directions when using the differential microphone as a single microphone (i.e., the directional pattern of the single microphone).

A reference numeral 1114 indicates the direction of a straight line that connects microphones when forming a differential microphone using two microphones or the direction of a straight line that connects the first through-hole and the second through-hole for allowing sound waves to reach both faces of a microphone when implementing a differential microphone using one microphone (0°-180°, two microphones M1 and M2 of the differential microphone or the first through-hole and the second through-holes are positioned on the straight line). The direction of the straight line is a 0°-180° direction, and a direction perpendicular to the direction of the straight line is a 90°-270° direction.

As indicated by 1112 and 1122, the single microphone uniformly collects sound from all directions and does not have directivity. The sound pressure collected by the single microphone is attenuated as the distance from the sound source increases.

As indicated by 1110 and 1120, the differential microphone shows a decrease in sensitivity to some extent in the 90° direction and the 270° direction, but has almost uniform directivity in all directions. The sound pressure collected by the differential microphone is attenuated as the distance from the sound source increases to a larger extent as compared with the single microphone.

As shown in FIG. 25B, when the frequency band of the sound source is 1 kHz and the microphone-microphone distance is 5 mm, the area indicated by the graph 1120 of the differential sound pressure which indicates the directivity of the differential microphone is included in the area of the graph 1122 which indicates the directivity of the single microphone. This means that the differential microphone reduces distant noise better than the single microphone.

Figure 26A:
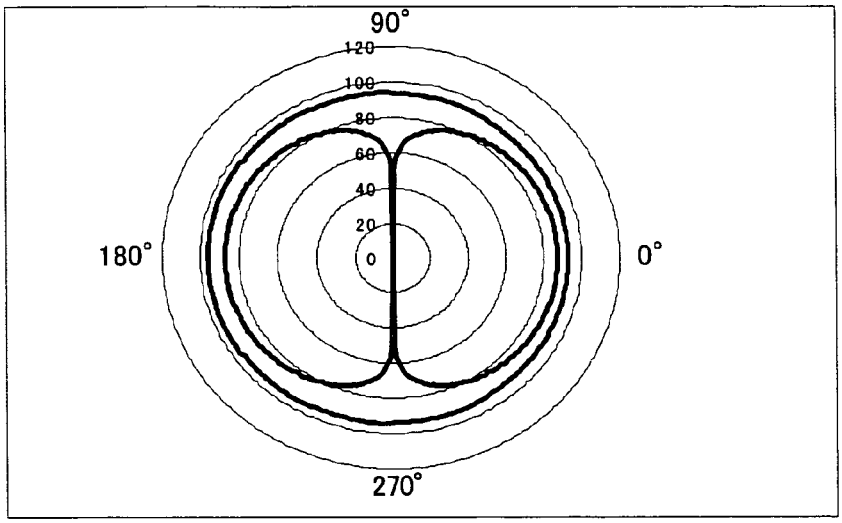
FIGS. 26A and 26B are diagrams illustrative of the directivity of a differential microphone when a microphone-microphone distance is 10 mm, a frequency band is 1 kHz, and a microphone-sound source distance is 2.5 cm or 1 m.
Figure 26B:
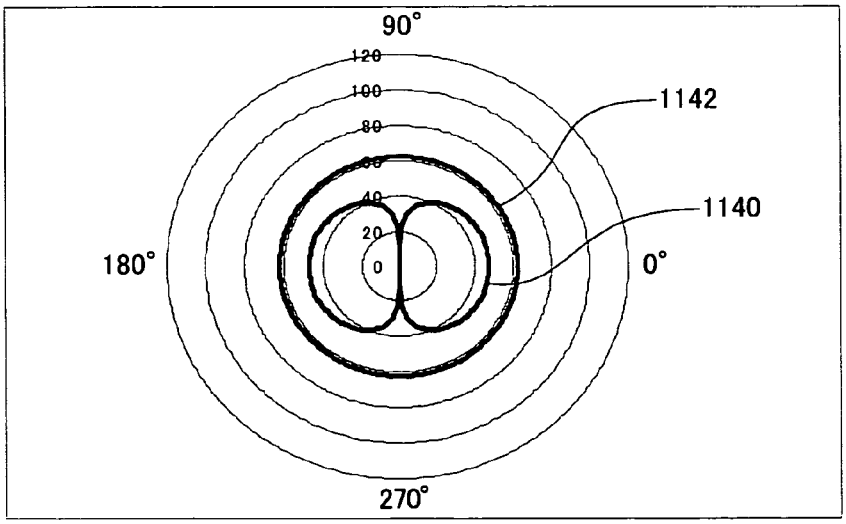

FIGS. 26A and 26B are diagrams showing the directivity of the differential microphone when the frequency band of the sound source is 1 kHz, the microphone-microphone distance is 10 mm, the microphone-sound source distance is 2.5 cm or 1 m. In this case, also, as shown in FIG. 26B, the area indicated by the graph 1140 of the differential sound pressure which indicates the directivity of the differential microphone is included in the area of the graph 1142 which indicates the directivity of the single microphone. This means that the differential microphone reduces distant noise better than the single microphone.

Figure 27A:
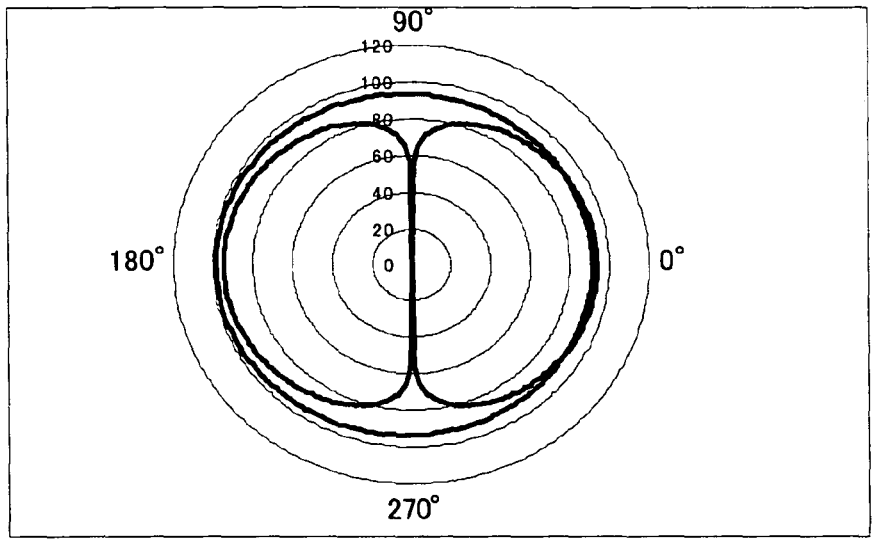
FIGS. 27A and 27B are diagrams illustrative of the directivity of a differential microphone when a microphone-microphone distance is 20 mm, a frequency band is 1 kHz, and a microphone-sound source distance is 2.5 cm or 1 m.
Figure 27B:
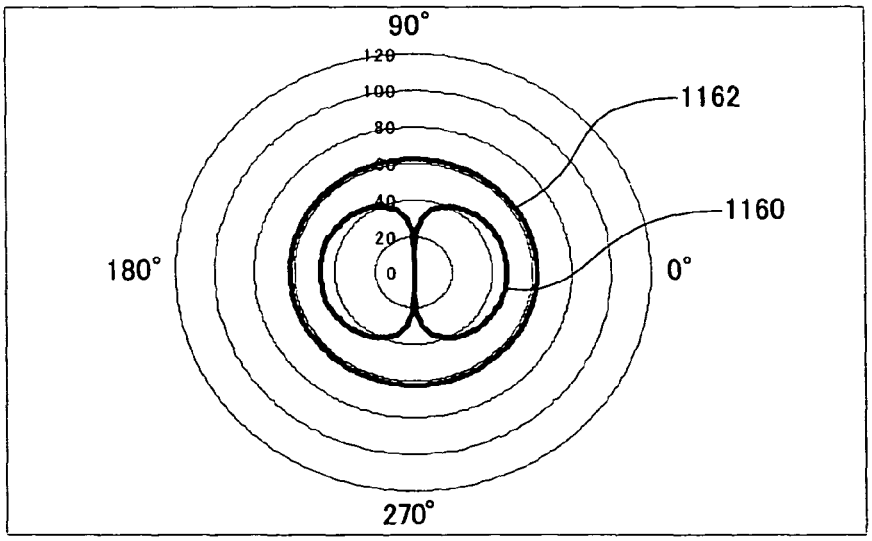

FIGS. 27A and 27B are diagrams showing the directivity of the differential microphone when the frequency band of the sound source is 1 kHz, the microphone-microphone distance is 20 mm, the microphone-sound source distance is 2.5 cm or 1 m. In this case, also, as shown in FIG. 27B, the area indicated by the graph 1160 of the differential sound pressure which indicates the directivity of the differential microphone is included in the area of the graph 1162 which indicates the directivity of the single microphone. This means that the differential microphone reduces distant noise better than the single microphone.

Figure 28A:
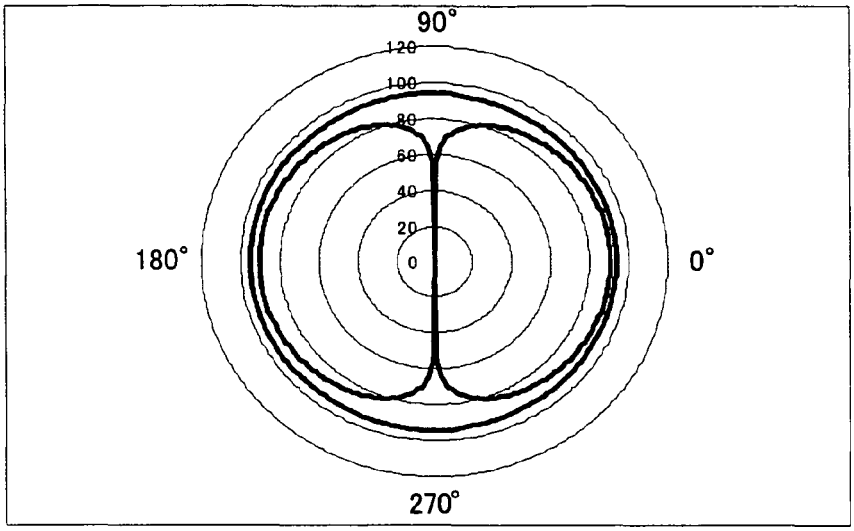
FIGS. 28A and 28B are diagrams illustrative of the directivity of a differential microphone when a microphone-microphone distance is 5 mm, a frequency band is 7 kHz, and a microphone-sound source distance is 2.5 cm or 1 m.
Figure 28B:
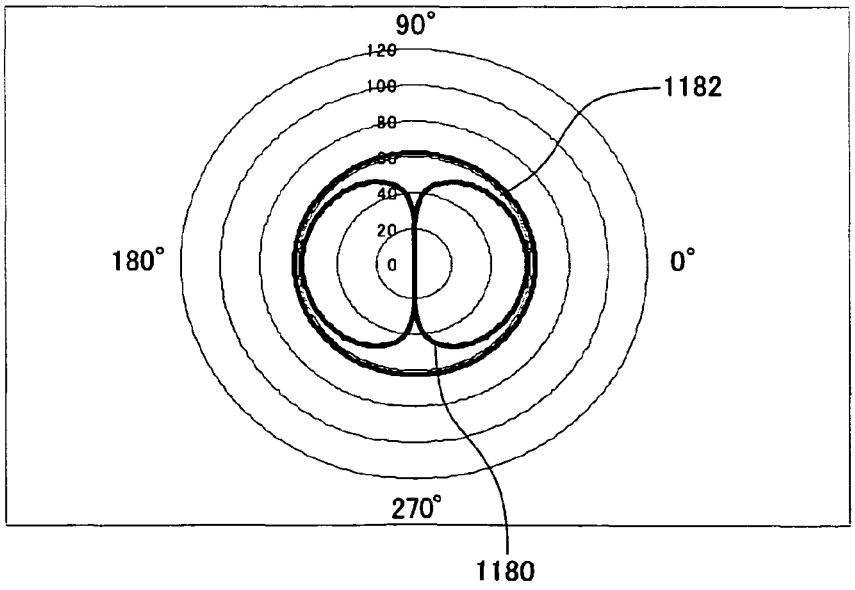

FIGS. 28A and 28B are diagrams showing the directivity of the differential microphone when the frequency band of the sound source is 7 kHz, the microphone-microphone distance is 5 mm, the microphone-sound source distance is 2.5 cm or 1 m. In this case, also, as shown in FIG. 28B, the area indicated by the graph 1180 of the differential sound pressure which indicates the directivity of the differential microphone is included in the area of the graph 1182 which indicates the directivity of the single microphone. This means that the differential microphone reduces distant noise better than the single microphone.

Figure 29A:
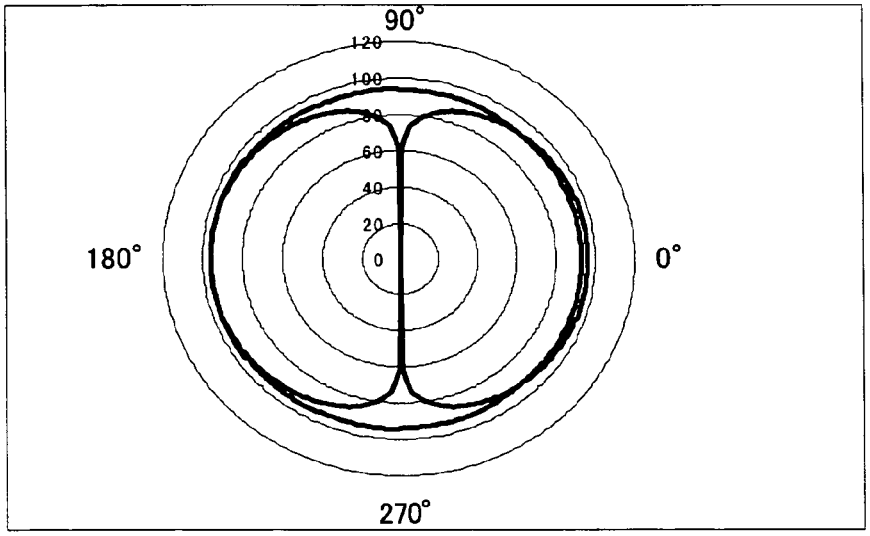
FIGS. 29A and 29B are diagrams illustrative of the directivity of a differential microphone when a microphone-microphone distance is 10 mm, a frequency band is 7 kHz, and a microphone-sound source distance is 2.5 cm or 1 m.
Figure 29B:
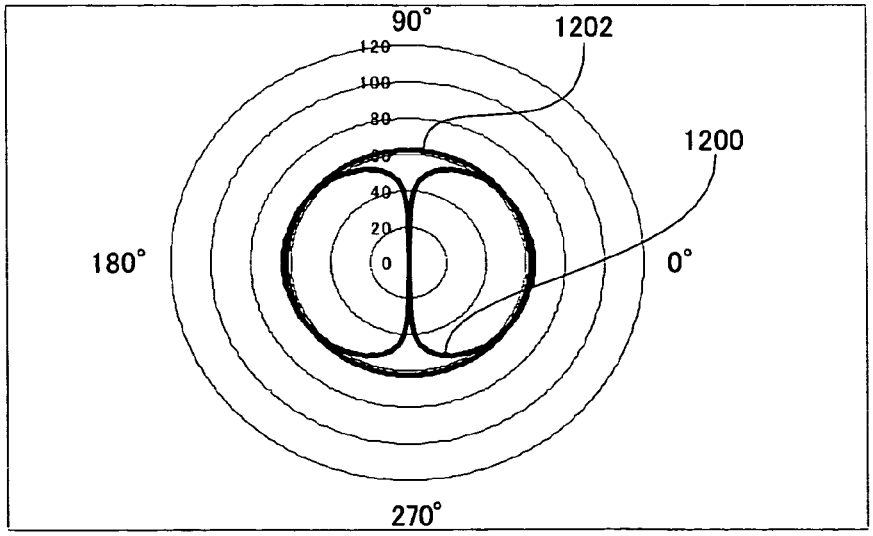

FIGS. 29A and 29B are diagrams showing the directivity of the differential microphone when the frequency band of the sound source is 7 kHz, the microphone-microphone distance is 10 mm, the microphone-sound source distance is 2.5 cm or 1 m. In this case, also, as shown in FIG. 29B, the area indicated by the graph 1200 of the differential sound pressure which indicates the directivity of the differential microphone is not included in the area of the graph 1202 which indicates the directivity of the single microphone. This means that the differential microphone reduces distant noise less than the single microphone.

Figure 30A:
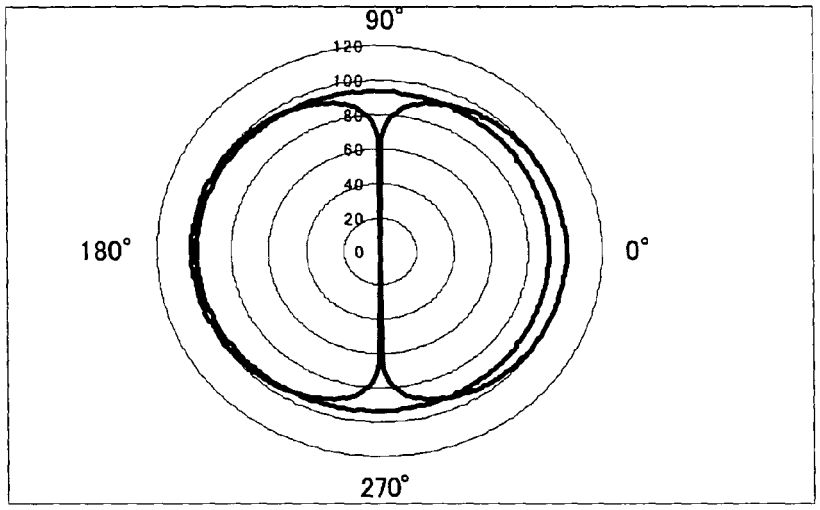
FIGS. 30A and 30B are diagrams illustrative of the directivity of a differential microphone when a microphone-microphone distance is 20 mm, a frequency band is 7 kHz, and a microphone-sound source distance is 2.5 cm or 1 m.
Figure 30B:
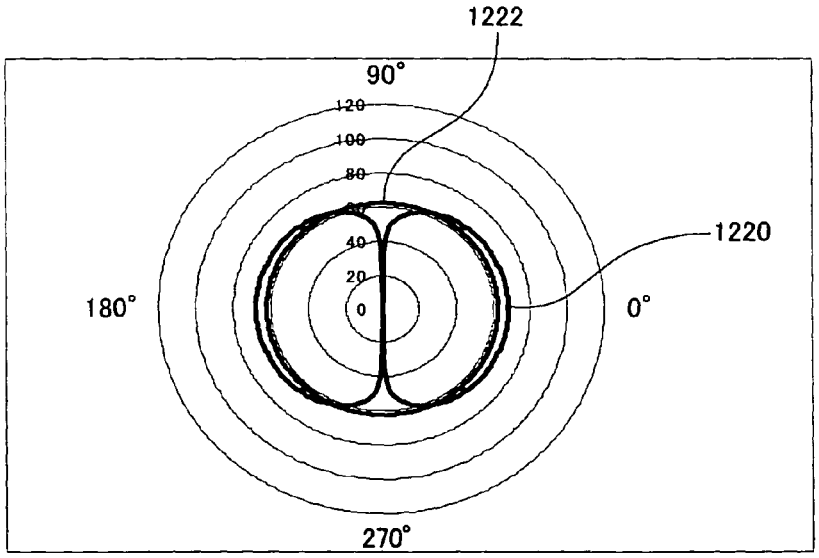

FIGS. 30A and 30B are diagrams showing the directivity of the differential microphone when the frequency band of the sound source is 7 kHz, the microphone-microphone distance is 20 mm, the microphone-sound source distance is 2.5 cm or 1 m. In this case, also, as shown in FIG. 29B, the area indicated by the graph 1220 of the differential sound pressure which indicates the directivity of the differential microphone is not included in the area of the graph 1222 which indicates the directivity of the single microphone. This means that the differential microphone reduces distant noise less than the single microphone.

Figure 31A:
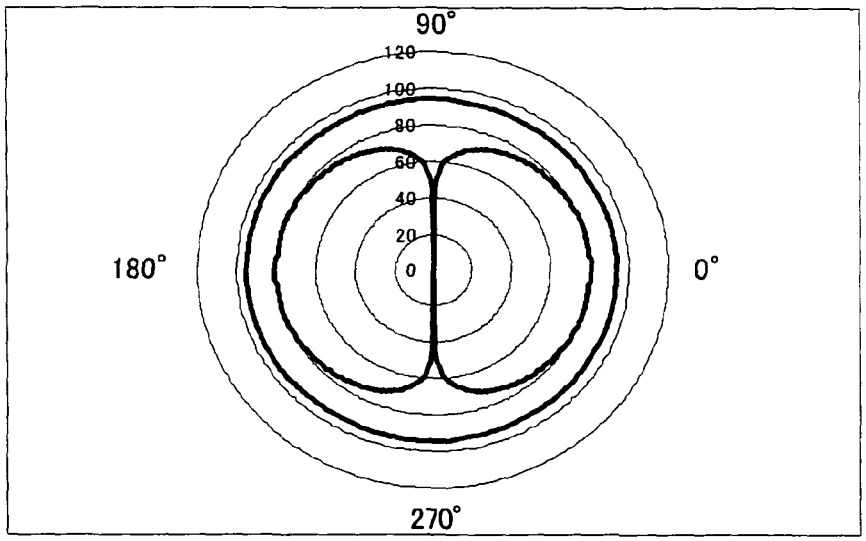
FIGS. 31A and 31B are diagrams illustrative of the directivity of a differential microphone when a microphone-microphone distance is 5 mm, a frequency band is 300 Hz, and a microphone-sound source distance is 2.5 cm or 1 m.
Figure 31B:
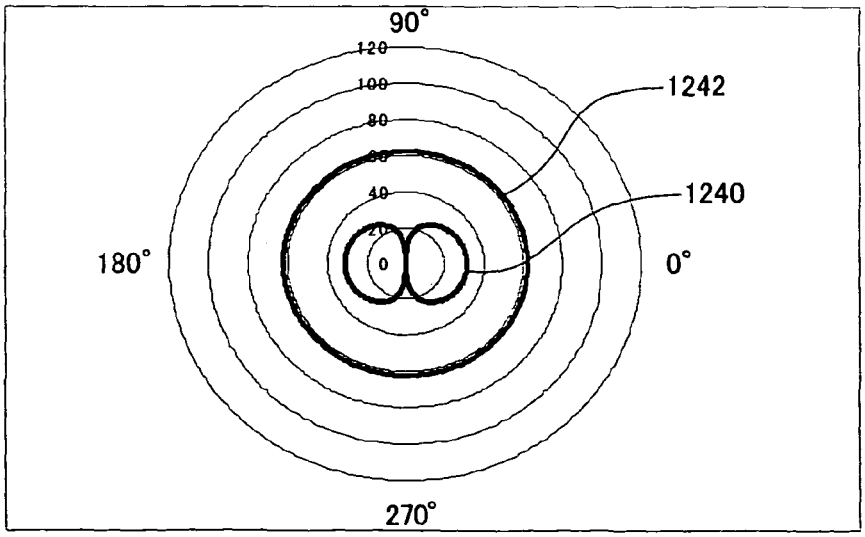

FIGS. 31A and 31B are diagrams showing the directivity of the differential microphone when the frequency band of the sound source is 300 Hz, the microphone-microphone distance is 5 mm, the microphone-sound source distance is 2.5 cm or 1 m. In this case, also, as shown in FIG. 31B, the area indicated by the graph 1240 of the differential sound pressure which indicates the directivity of the differential microphone is included in the area of the graph 1242 which indicates the directivity of the single microphone. This means that the differential microphone reduces distant noise better than the single microphone.

Figure 32A:
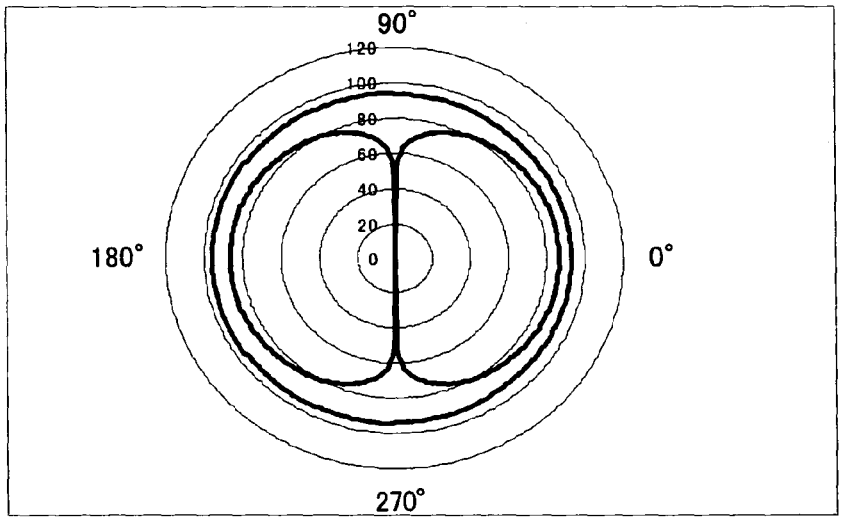
FIGS. 32A and 32B are diagrams illustrative of the directivity of a differential microphone when a microphone-microphone distance is 10 mm, a frequency band is 300 Hz, and a microphone-sound source distance is 2.5 cm or 1 m.
Figure 32B:
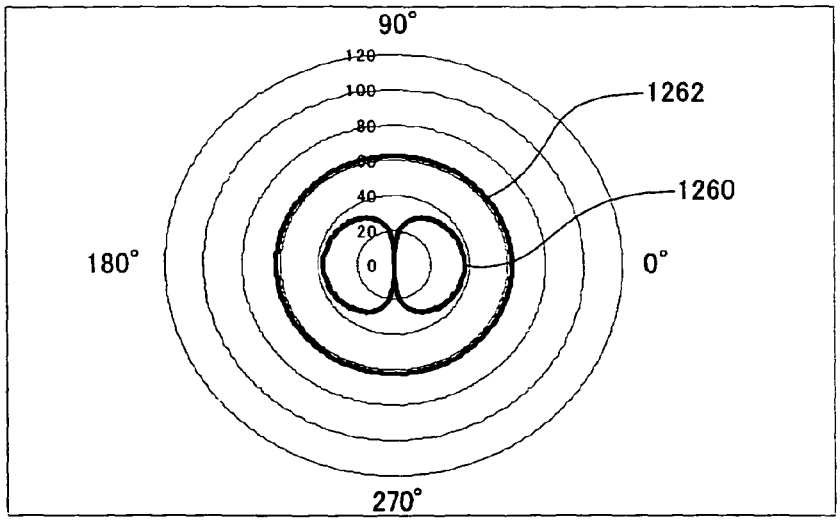

FIGS. 32A and 32B are diagrams showing the directivity of the differential microphone when the frequency band of the sound source is 300 Hz, the microphone-microphone distance is 10 mm, the microphone-sound source distance is 2.5 cm or 1 m. In this case, also, as shown in FIG. 32B, the area indicated by the graph 1260 of the differential sound pressure which indicates the directivity of the differential microphone is included in the area of the graph 1262 which indicates the directivity of the single microphone. This means that the differential microphone reduces distant noise better than the single microphone.

Figure 33A:
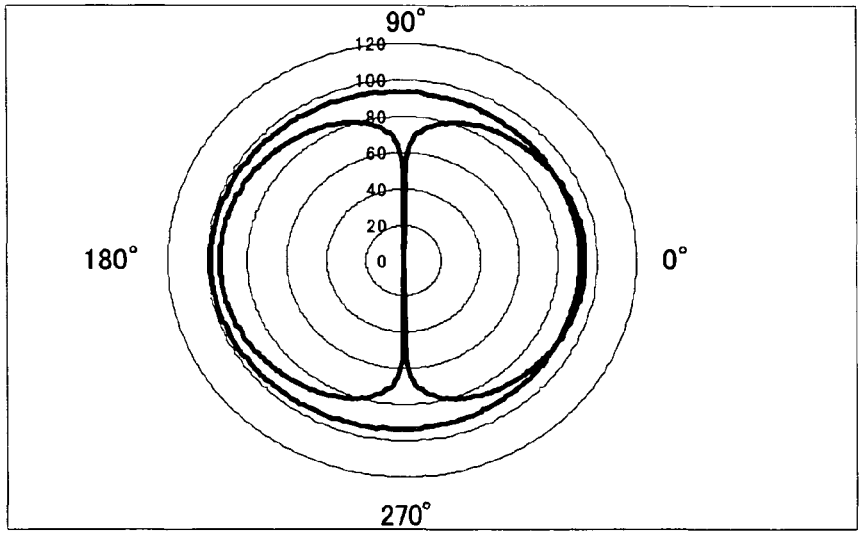
FIGS. 33A and 33B are diagrams illustrative of the directivity of a differential microphone when a microphone-microphone distance is 20 mm, a frequency band is 300 Hz, and a microphone-sound source distance is 2.5 cm or 1 m.
Figure 33B:
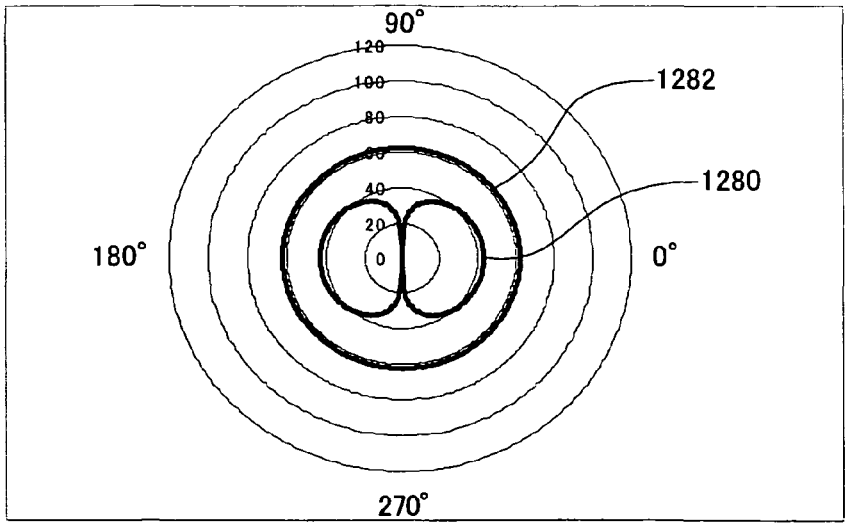

FIGS. 33A and 33B are diagrams showing the directivity of the differential microphone when the frequency band of the sound source is 300 Hz, the microphone-microphone distance is 20 mm, the microphone-sound source distance is 2.5 cm or 1 m. In this case, also, as shown in FIG. 33B, the area indicated by the graph 1280 of the differential sound pressure which indicates the directivity of the differential microphone is included in the area of the graph 1282 which indicates the directivity of the single microphone. This means that the differential microphone reduces distant noise better than the single microphone.

As shown in FIGS. 25B, 28B, and 31B, when the microphone-microphone distance is 5 mm, the area indicated by the graph which indicates the directivity of the differential microphone is included in the area of the graph which indicates the directivity of the single microphone when the frequency band of sound is 1 kHz, 7 kHz, or 300 Hz. Specifically, when the microphone-microphone distance is 5 mm, the differential microphone exhibits an excellent distant noise reduction effect as compared with the single microphone when the frequency band of sound is about 7 kHz.

As shown in FIGS. 26B, 29B, and 32B, when the microphone-microphone distance is 10 mm, the area indicated by the graph which indicates the directivity of the differential microphone is not included in the area of the graph which indicates the directivity of the single microphone when the frequency band of sound is 7 kHz. Specifically, when the microphone-microphone distance is 10 mm, the differential microphone does not exhibit an excellent distant noise reduction effect as compared with the single microphone when the frequency band of sound is about 7 kHz.

As shown in FIGS. 27B, 30B, and 33B, when the microphone-microphone distance is 20 mm, the area indicated by the graph which indicates the directivity of the differential microphone is not included in the area of the graph which indicates the directivity of the single microphone when the frequency band of sound is 7 kHz. Specifically, when the microphone-microphone distance is 20 mm, the differential microphone does not exhibit an excellent distant noise suppression effect as compared with the single microphone when the frequency band of sound is about 7 kHz.

Therefore, the differential microphone exhibits an excellent distant noise suppression effect as compared with the single microphone independent of directivity when the frequency band of sound is 7 kHz or less by setting the microphone-microphone distance at about 5 mm to about 6 mm (5.2 mm or less in detail).

When implementing a differential microphone using one microphone, the above description applies to the distance between the first through-hole and the second through-hole for allowing sound waves to reach both faces of the microphone. According to this embodiment, a microphone unit which can suppress distant noise from all directions independent of directivity when the frequency band of sound is 7 kHz or less can be implemented by setting the center-to-center distances between the first and second through-holes 12 and 14 at about 5 mm to about 6 mm (5.2 mm or less in detail).

According to the microphone unit 1, the housing 10 (i.e., the positions of the first and second through-holes 12 and 14) can be designed so that noise which enters the housing 10 so that the noise intensity ratio based on the phase difference becomes a maximum can be removed. Therefore, the microphone unit 1 can remove noise incident from all directions. According to this embodiment, a microphone unit which can remove noise incident from all directions can be provided.

The microphone unit 1 can also remove a user's voice component incident on the diaphragm 30 (first and second faces 35 and 37) after being reflected by a wall or the like. Specifically, since a user's voice reflected by a wall or the like enters the microphone unit 1 after traveling over a long distance, such a user's voice can be considered to be produced from a sound source positioned away from the microphone unit 1 as compared with a normal user's voice. Moreover, since the energy of such a user's voice has been reduced to a large extent due to reflection, the sound pressure is not attenuated to a large extent between the first and second through-holes 12 and 14 in the same manner as a noise component. Therefore, the microphone unit 1 also removes a user's voice component incident on the diaphragm after being reflected by a wall or the like in the same manner as noise (as one type of noise).

A signal which represents a user's voice and does not contain noise can be obtained utilizing the microphone unit 1. Therefore, highly accurate speech (voice) recognition, voice authentication, and command generation can be implemented utilizing the microphone unit 1.

6. Voice Input Device

A voice input device 2 including the microphone unit 1 is described below.

(1) Configuration of Voice Input Device 2

Figure 8:
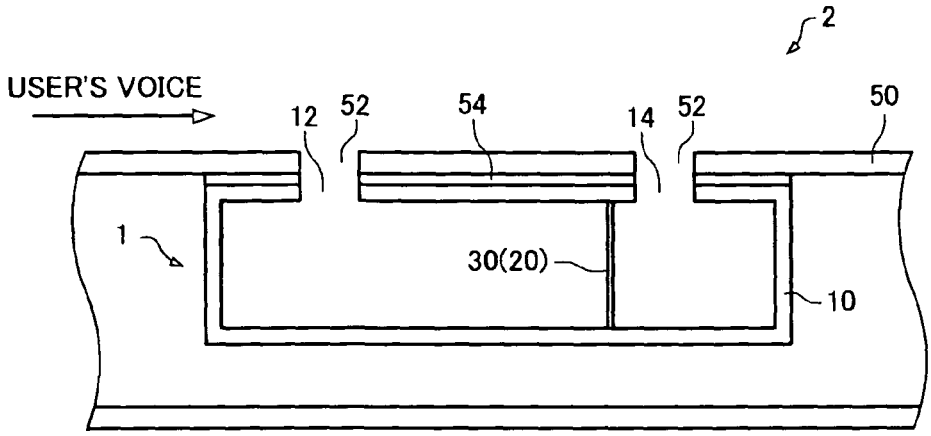
FIG. 8 is a diagram illustrative of a voice input device.
Figure 9:
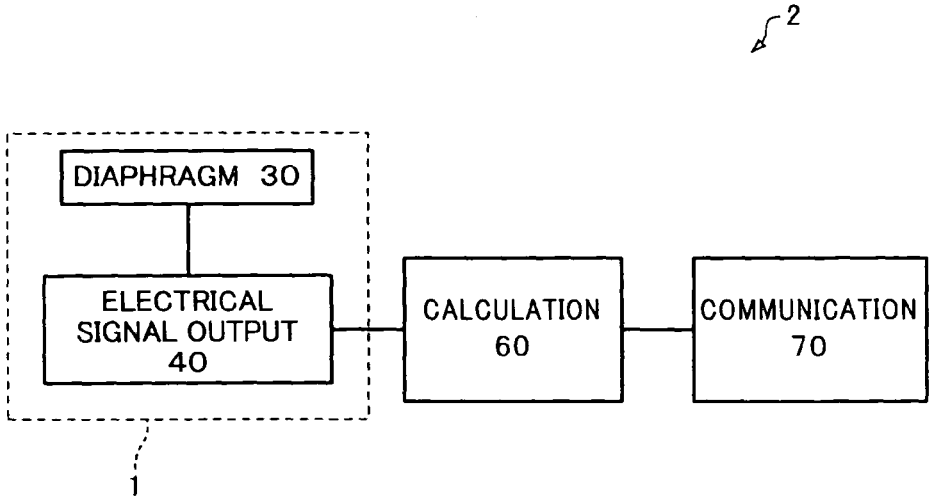
FIG. 9 is a diagram illustrative of a voice input device.

The configuration of the voice input device 2 is described below. FIGS. 8 and 9 are diagrams illustrative of the configuration of the voice input device 2. The voice input device 2 described below is a close-talking voice input device, and may be applied to voice communication instruments such as a portable telephone and a transceiver, information processing systems utilizing input voice analysis technology (e.g., voice authentication system, speech recognition system, command generation system, electronic dictionary, translation device, and voice input remote controller), recording devices, amplifier systems (loudspeaker), microphone systems, and the like.

FIG. 8 is a diagram illustrative of the structure of the voice input device 2.

The voice input device 2 includes a housing 50. The housing 50 is a member which defines the external shape of the voice input device 2. The basic position of the housing 50 may be set in advance. This limits the travel path of the user's voice. Openings 52 which receive the user's voice may be formed in the housing 50.

In the voice input device 2, the microphone unit 1 is provided in the housing 50. The microphone unit 1 may be provided in the housing 50 so that the first and second through-holes 12 and 14 communicate with (overlap or coincide with) the openings 52. The microphone unit 1 may be provided in the housing 50 through an elastic body 54 In this case, vibrations of the housing 50 are transmitted to the microphone unit 1 (housing 10) to only a small extent, whereby the microphone unit 1 can be operated with high accuracy.

The microphone unit 1 may be provided in the housing 50 so that the first and second through-holes 12 and 14 are disposed at different positions along the travel direction of the user's voice. The through-hole disposed on the upstream side of the travel path of the user's voice may be the first through-hole 12, and the through-hole disposed on the downstream side of the travel path of the user's voice may be the second through-hole 14. The user's voice can be simultaneously incident on each face (first and second faces 35 and 37) of the diaphragm 30 by thus disposing the microphone unit 1 in which the diaphragm 30 is disposed on the side of the second through-hole 14. In the microphone unit 1, since the distance between the center of the first through-hole 12 and the first face 35 is almost equal to the distance between the first through-hole 12 and the second through-hole 14, the period of time required for the user's voice which has passed through the first through-hole 12 to be incident on the first face 35 is almost equal to the period of time required for the user's voice which has traveled over the first through-hole 12 to be incident on the second face 37 through the second through-hole 14. Specifically, the period of time required for the user's voice to be incident on the first face 35 is almost equal to the period of time required for the user's voice to be incident on the second face 37. This makes it possible for the user's voice to be simultaneously incident on the first and second faces 35 and 37, whereby the diaphragm 30 can be caused to vibrate so that noise due to phase shift does not occur. In other words, since $\alpha=0$ and $\sin \omega t-\sin(\omega t-\alpha)=0$ in the expression (8), the term $\Delta r/R \sin \omega t$ (only the amplitude component) is extracted. Therefore, even when a user's voice in a high frequency band of about 7 KHz is input, the effect of phase distortion of the sound pressure incident on the first face 35 and the sound pressure incident on the second face 37 can be disregarded, whereby an electrical signal which accurately represents the user's voice can be acquired.

(2) Function of Voice Input Device 2

The function of the voice input device 2 is described below with reference to FIG. 9. FIG. 9 is a block diagram illustrative of the function of the voice input device 2.

The voice input device 2 includes the microphone unit 1. The microphone unit 1 outputs an electrical signal generated based on vibrations of the diaphragm 30. The electrical signal output from the microphone unit 1 is an electrical signal which represents the user's voice from which the noise component has been removed.

The voice input device 2 may include a calculation section 60. The calculation section 60 performs various calculations based on the electrical signal output from the microphone unit 1 (electrical signal output circuit 40). The calculation section 60 may analyze the electrical signal. The calculation section 60 may specify a person who has produced the user's voice by analyzing the output signal from the microphone unit 1 (voice authentication process). The calculation section 60 may specify the content of the user's voice by analyzing the output signal from the microphone unit 1 (speech recognition process). The calculation section 60 may create various commands based on the output signal from the microphone unit 1. The calculation section 60 may amplify the output signal from the microphone unit 1. The calculation section 60 may control the operation of a communication section 70 described later. The calculation section 60 may implement the above-mentioned functions by signal processing using a CPU and a memory. The calculation section 60 may implement the above-mentioned functions by signal processing using dedicated hardware.

The voice input device 2 may further include the communication section 70. The communication section 70 controls communication between the voice input device 2 and another terminal (e.g., portable telephone terminal or host computer). The communication section 70 may have a function of transmitting a signal (output signal from the microphone unit 1) to another terminal through a network. The communication section 70 may have a function of receiving a signal from another terminal through a network. A host computer may analyze the output signal acquired through the communication section 70, and perform various information processes such as a speech recognition process, a voice authentication process, a command generation process, and a data storage process. Specifically, the voice input device 2 may form an information processing system with another terminal. In other words, the voice input device 2 may be considered to be an information input terminal which forms an information processing system. Note that the voice input device 2 may not include the communication section 70.

The calculation section 60 and the communication section 70 may be disposed in the housing 50 as a packaged semiconductor device (integrated circuit device). Note that the invention is not limited thereto. For example, the calculation section 60 may be disposed outside the housing 50. When the calculation section 60 is disposed outside the housing 50, the calculation section 60 may acquire a differential signal through the communication section 70.

The voice input device 2 may further include a display device such as a display panel and a sound output device such as a speaker. The voice input device 2 may further include an operation key for inputting operation information.

The voice input device 2 may have the above-described configuration. The voice input device 2 utilizes the microphone unit 1. Therefore, the voice input device 2 can acquire a signal which represents an input voice and does not contain noise, and implement highly accurate speech recognition, voice authentication, and command generation.

When applying the voice input device 2 to a microphone system, a user's voice output from a speaker is also removed as noise. Therefore, a microphone system in which howling rarely occurs can be provided.

Figure 10:
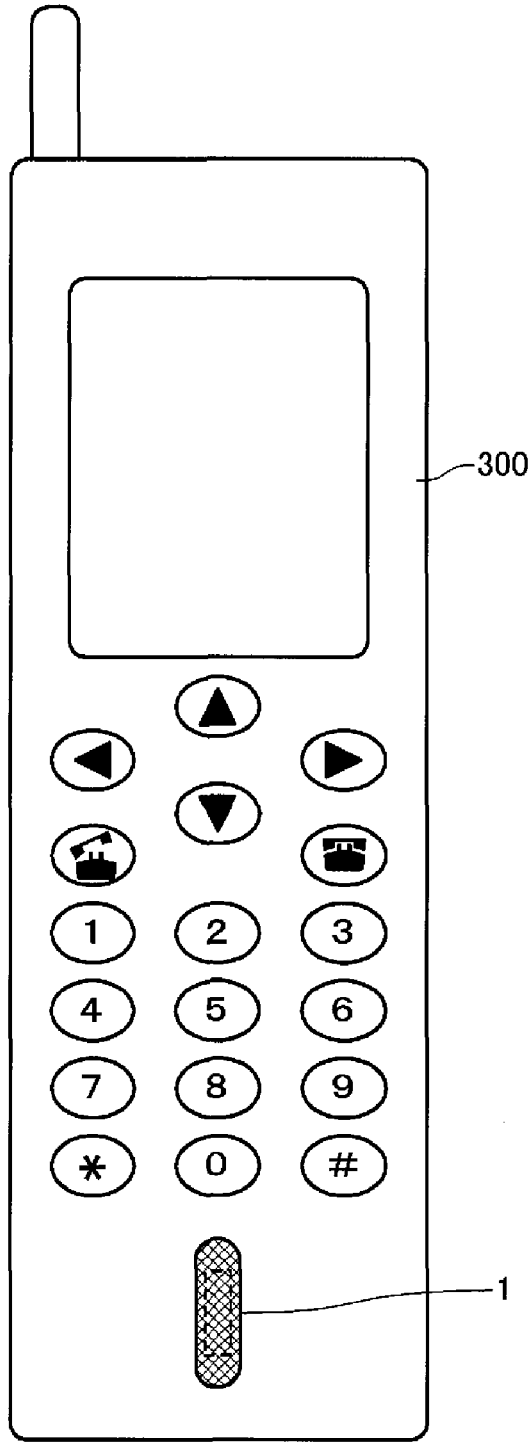
FIG. 10 is a diagram showing a portable telephone as an example of a voice input device.
Figure 11:
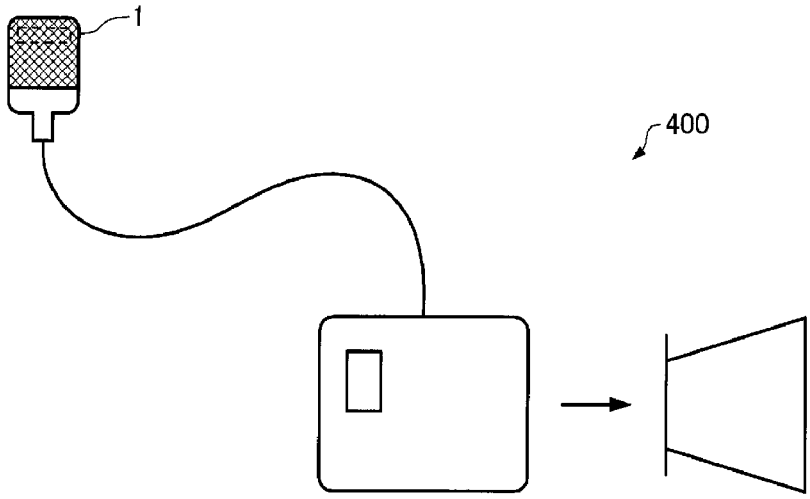
FIG. 11 is a diagram showing a microphone as an example of a voice input device.
Figure 12:
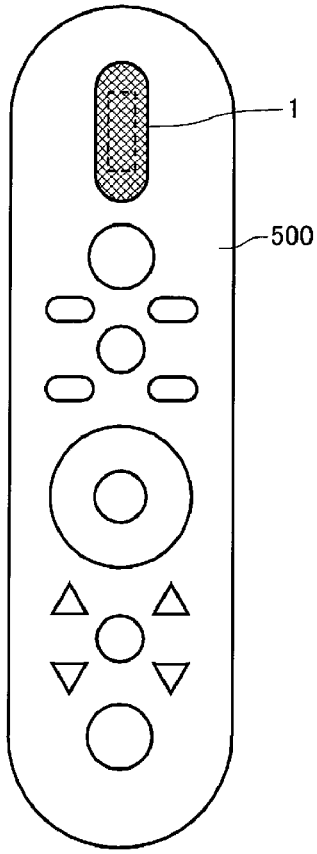
FIG. 12 is a diagram showing a remote controller as an example of a voice input device.
Figure 13:
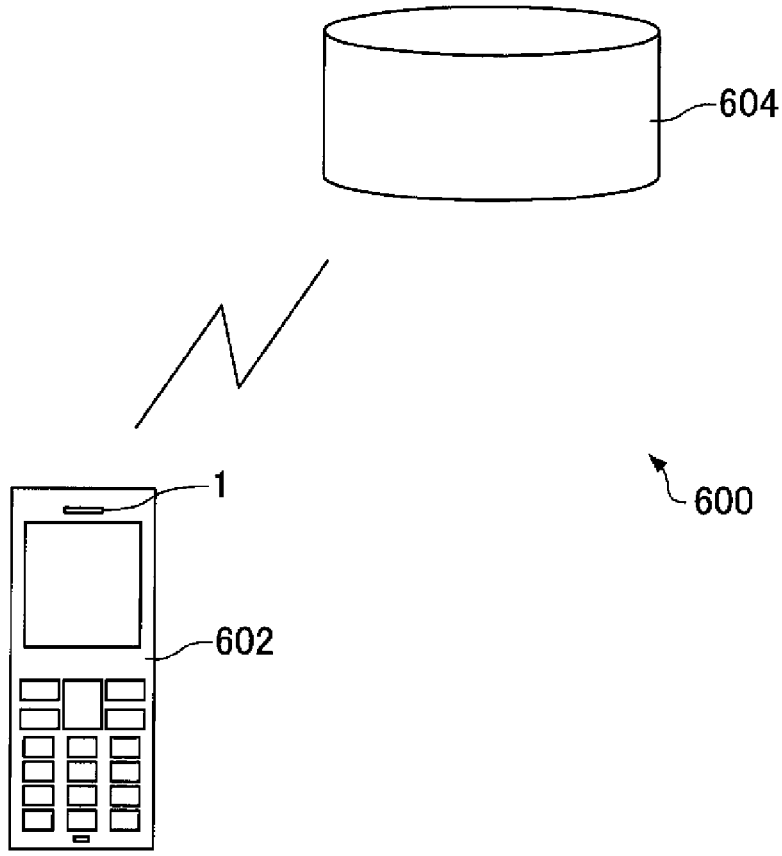
FIG. 13 is a schematic diagram showing an information processing system.

FIGS. 10 to 12 respectively show a portable telephone 300, a microphone (microphone system) 400, and a remote controller 500 as examples of the voice input device 2. FIG. 13 is a schematic diagram showing an information processing system 600 which includes a voice input device 602 as an information input terminal and a host computer 604.

7. Modification

The invention is not limited to the above-described embodiments, and various modifications can be made. For example, the invention includes various other configurations substantially the same as the configurations described in the embodiments (in function, method and result, or in objective and result, for example). The invention also includes a configuration in which an unsubstantial portion in the described embodiments is replaced. The invention also includes a configuration having the same effects as the configurations described in the embodiments, or a configuration able to achieve the same objective. Further, the invention includes a configuration in which a publicly known technique is added to the configurations in the embodiments.

Specific modifications are given below.

(1) First Modification

Figure 14:
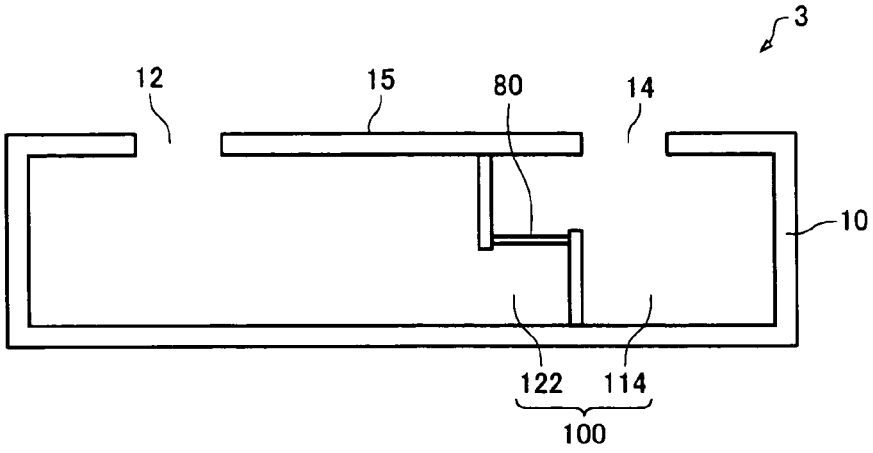
FIG. 14 is diagram illustrative of a microphone unit according to a modification of one embodiment of the invention.

FIG. 14 shows a microphone unit 3 according to a first modification of the embodiment to which the invention is applied.

The microphone unit 3 includes a diaphragm 80. The diaphragm 80 forms part of a partition member which divides the inner space 100 of the housing 10 into a first space 112 and a second space 114. The diaphragm 80 is provided so that the normal to the diaphragm 80 perpendicularly intersects the face 15 (i.e., parallel to the face 15). The diaphragm 80 may be provided on the side of the second through-hole 14 so that the diaphragm 80 does not overlap the first and second through-holes 12 and 14. The diaphragm 80 may be disposed at an interval from the inner wall surface of the housing 10.

(2) Second Modification

Figure 15:
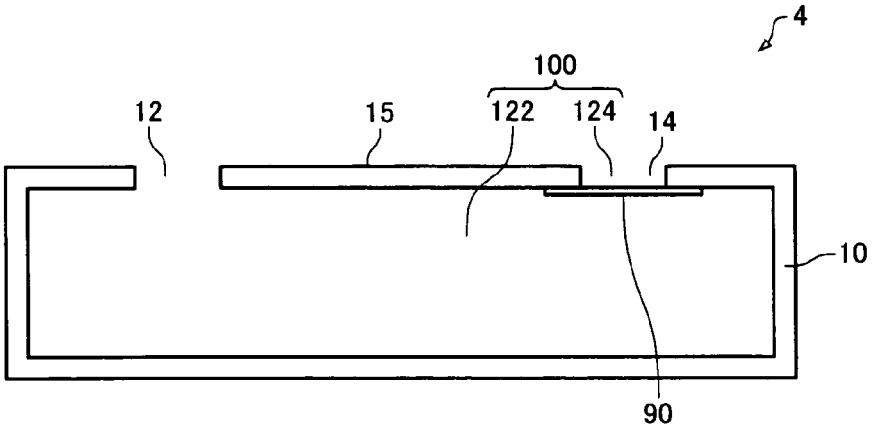
FIG. 15 is diagram illustrative of a microphone unit according to a modification of one embodiment of the invention.

FIG. 15 shows a microphone unit 4 according to a second modification of the embodiment to which the invention is applied.

The microphone unit 4 includes a diaphragm 90. The diaphragm 90 forms part of a partition member which divides the inner space 100 of the housing 10 into a first space 122 and a second space 124. The diaphragm 90 is provided so that the normal to the diaphragm 90 perpendicularly intersects the face 15. The diaphragm 90 is provided to be flush with the inner wall surface (i.e., face opposite to the face 15) of the housing 10. The diaphragm 90 may be provided to close the second through-hole 14 from the inside (inner space 100) of the housing 10. In the microphone unit 3, only the inner space of the second through-hole 14 may be the second space 124, and the inner space 100 other than the second space 124 may be the first space 122. This makes it possible to design the housing 10 to a small thickness.

(3) Third Modification

Figure 16:
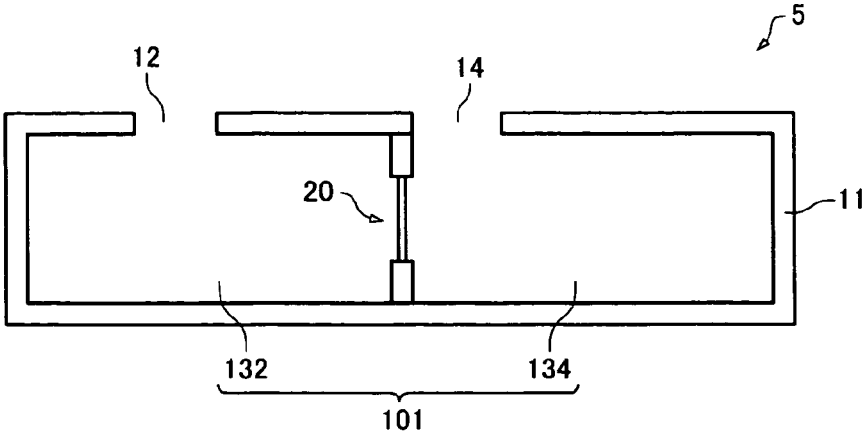
FIG. 16 is diagram illustrative of a microphone unit according to a modification of one embodiment of the invention.

FIG. 16 shows a microphone unit 5 according to a third modification of the embodiment to which the invention is applied.

The microphone unit 5 includes a housing 11. The housing 11 has an inner space 101. The inner space 101 is divided into a first region 132 and a second region 134 by the partition member 20. In the microphone unit 5, the partition member 20 is disposed on the side of the second through-hole 14. In the microphone unit 5, the partition member 20 divides the inner space 101 so that the first and second spaces 132 and 134 have an equal volume.

(4) Fourth Modification

Figure 17:
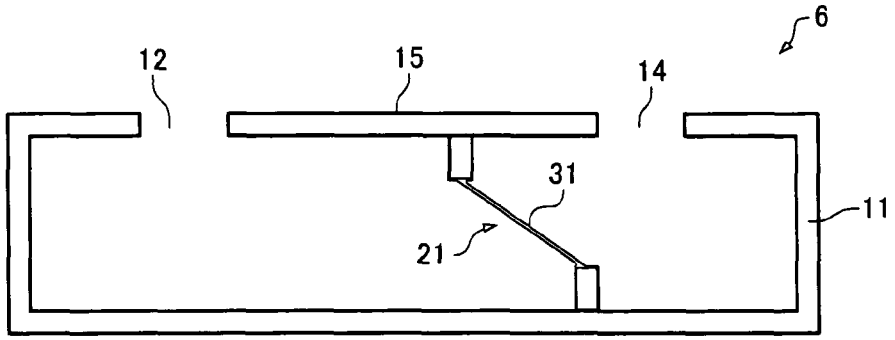
FIG. 17 is diagram illustrative of a microphone unit according to a modification of one embodiment of the invention.

FIG. 17 shows a microphone unit 6 according to a fourth modification of the embodiment to which the invention is applied.

As shown in FIG. 17, the microphone unit 6 includes a partition member 21. The partition member 21 includes a diaphragm 31. The diaphragm 31 is held inside the housing 10 so that the normal to the diaphragm 31 diagonally intersects the face 15.

(5) Fifth Modification

Figure 18:
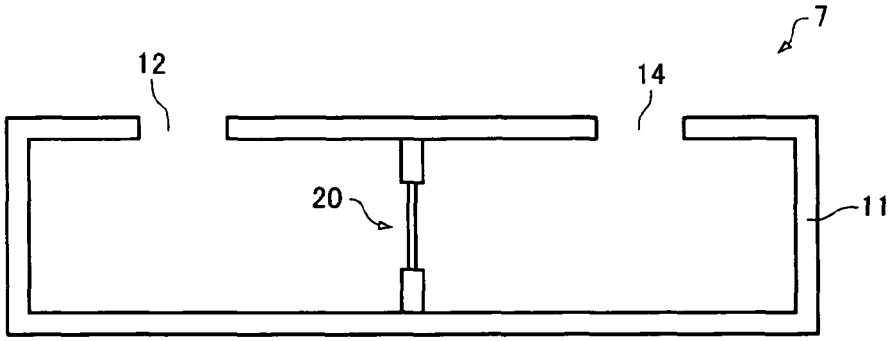
FIG. 18 is diagram illustrative of a microphone unit according to a modification of one embodiment of the invention.

FIG. 18 shows a microphone unit 7 according to a fifth modification of the embodiment to which the invention is applied.

In the microphone unit 7, the partition member 20 is disposed midway between the first and second through-holes 12 and 14, as shown in FIG. 18. Specifically, the distance between the first through-hole 12 and the partition member 20 is equal to the distance between the second through-hole 14 and the partition member 20. In the microphone unit 7, the partition member 20 may be disposed to equally divide the inner space 100 of the housing 10.

(6) Sixth Modification

Figure 19:
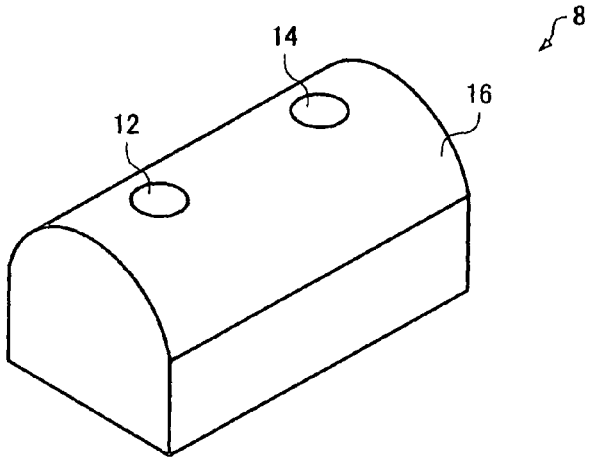
FIG. 19 is diagram illustrative of a microphone unit according to a modification of one embodiment of the invention.

FIG. 19 shows a microphone unit 8 according to a sixth modification of the embodiment to which the invention is applied.

In the microphone unit 8, the housing has a convex curved surface 16, as shown in FIG. 19. The first and second through-holes 12 and 14 are formed in the convex curved surface 16.

(7) Seventh Modification

Figure 20:
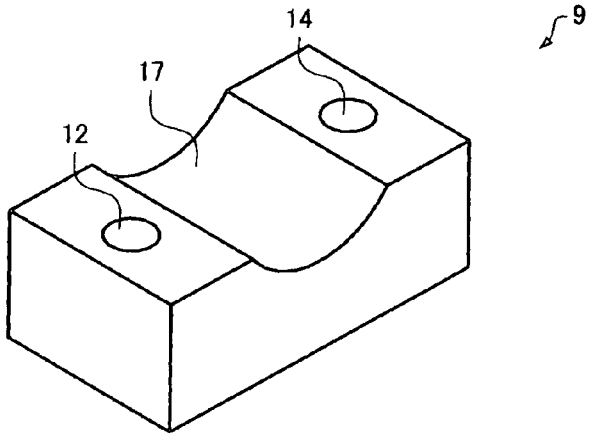
FIG. 20 is diagram illustrative of a microphone unit according to a modification of one embodiment of the invention.

FIG. 20 shows a microphone unit 9 according to a seventh modification of the embodiment to which the invention is applied.

In the microphone unit 9, the housing has a concave curved surface 17, as shown in FIG. 20. The first and second through-holes 12 and 14 may be disposed on either side of the concave curved surface 17. The first and second through-holes 12 and 14 may be formed in the concave curved surface 17.

(8) Eighth Modification

Figure 21:
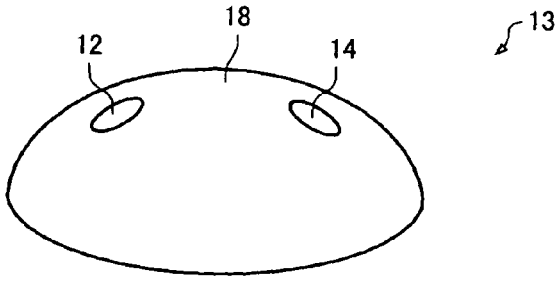
FIG. 21 is diagram illustrative of a microphone unit according to a modification of one embodiment of the invention.

FIG. 21 shows a microphone unit 13 according to an eighth modification of the embodiment to which the invention is applied.

In the microphone unit 13, the housing has a spherical surface 18, as shown in FIG. 21. The bottom surface of the spherical surface 18 may be circular or oval. Note that the shape of the bottom surface of the spherical surface 18 is not particularly limited. The first and second through-holes 12 and 14 are formed in the spherical surface 18.

The above-described effects can also be achieved using these microphone units. Therefore, an electrical signal which represents only a user's voice and does not contain a noise component can be obtained by acquiring an electrical signal based on vibrations of the diaphragm.

Although only some embodiments of this invention have been described in detail above, those skilled in the art will readily appreciate that many modifications are possible in the embodiments without materially departing from the novel teachings and advantages of this invention. Accordingly, all such modifications are intended to be included within the scope of the invention.

What is claimed is:

1. A method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole in the housing through which the first space communicates with an outer space of the housing and forming a second through-hole in the housing through which the second space communicates with the outer space, wherein a center-to-center distance between the first through-hole and the second through-hole is set within a range in which a sound pressure when using the diaphragm as a differential microphone is equal to or less than a sound pressure when using the diaphragm as a single microphone with respect to sound in a frequency band of 10 kHz or less; and wherein the diaphragm is disposed closer to either the first through-hole or the second through-hole so that a distance between the diaphragm and the first through-hole is not equal to a distance between the diaphragm and the second through-hole.

2. A method of manufacturing a microphone unit including a housing which has an inner space, a partition member which is provided in the housing and divides the inner space into a first space and a second space, the partition member being at least partially formed of a diaphragm, and an electrical signal output circuit which outputs an electrical signal based on vibrations of the diaphragm, the method comprising:

forming a first through-hole in the housing through which the first space communicates with an outer space of the housing and forming a second through-hole in the housing through which the second space communicates with the outer space in the housing, wherein a center-to-center distance between the first through-hole and the second through-hole is set within a range in which a sound pressure when using the diaphragm as a differential microphone is equal to or less than a sound pressure when using the diaphragm as a single microphone in all directions with respect to sound in an extraction target frequency; and wherein the diaphragm is disposed closer to either the first through-hole or the second through-hole so that a distance between the diaphragm and the first through-hole is not equal to a distance between the diaphragm and the second through-hole.

3. A microphone unit comprising:

a housing which has an inner space;

a partition member which is provided in the housing and divides the inner space into a first space and a second space, the partition member being at least partially formed of a diaphragm;

an electrical signal output circuit which outputs an electrical signal based on vibrations of the diaphragm; and a first through-hole formed in the housing through which the first space communicates with an outer space of the housing and a second through-hole formed in the housing through which the second space communicates with the outer space, wherein a center-to-center distance between the first through-hole and the second through-hole is set within a range in which a sound pressure when using the diaphragm as a differential microphone is equal to or less than a sound pressure when using the diaphragm as a single microphone with respect to sound in a frequency band of 10 kHz or less; and wherein the diaphragm is disposed closer to either the first through-hole or the second through-hole so that a distance between the diaphragm and the first through-hole is not equal to a distance between the diaphragm and the second through-hole.

4. The microphone unit as defined in claim 3, wherein the partition member is provided so that a medium that propagates sound waves does not move between the first space and the second space inside the housing.

5. The microphone unit as defined in claim 3, wherein the housing has a polyhedral external shape; and wherein the first through-hole and the second through-hole are formed in one face of the polyhedron.

6. The microphone unit as defined in claim 5, wherein the diaphragm is disposed so that a normal to the diaphragm is in parallel to the face.

7. The microphone unit as defined in claim 5, wherein the diaphragm is disposed so that a normal to the diaphragm perpendicularly intersects the face.

8. The microphone unit as defined in claim 5, wherein a center-to-center distance between the first through-hole and the second through-hole is 5.2 mm or less.

9. The microphone unit as defined in claim 3, wherein the diaphragm is disposed so that the diaphragm does not overlap the first through-hole or the second through-hole.

10. The microphone unit as defined in claim 3, wherein a center-to-center distance between the first through-hole and the second through-hole is 5.2 mm or less.

11. The microphone unit as defined in claim 3, wherein the electrical signal output circuit is at least partially formed in the housing.

12. The microphone unit as defined in claim 3, wherein the housing has a shielding structure which electromagnetically separates the inner space and the outer space of the housing.

13. The microphone unit as defined in claim 3, wherein the diaphragm includes a vibrator having an SN ratio of about 60 dB or more.

14. A close-talking voice input device comprising the microphone unit as defined in claim 3.

15. The voice input device as defined in claim 14, wherein the housing has a polyhedral external shape; and wherein the first through-hole and the second through-hole are formed in one face of the polyhedron.

16. The voice input device as defined in claim 14, wherein a center-to-center distance between the first through-hole and the second through-hole is 5.2 mm or less.

17. The voice input device as defined in claim 14, wherein the diaphragm includes a vibrator having an SN ratio of about 60 dB or more.

18. The voice input device as defined in claim 14, wherein the microphone unit is provided in the housing of a voice input device so that the first and second through-holes are disposed at different positions along a travel direction of a user's voice which is limited by a position of the housing in the voice input device.

19. The microphone unit as defined in claim 3, wherein the microphone unit is provided in the housing of a voice input device so that the first and second through-holes are disposed at different positions along a travel direction of a user's voice which is limited by a position of the housing in the voice input device.

20. The microphone unit as defined in claim 3, wherein a center-to-center distance between the first through-hole and the second through-hole is set so that a phase component intensity ratio of a user's voice is smaller than an amplitude component intensity ratio.

21. The microphone unit as defined in claim 3, wherein a center-to-center distance between the first through-hole and the second through-hole is set so that a phase component intensity ratio of a noise is 0 dB or less.

22. A microphone unit comprising:

a housing which has an inner space;

a partition member which is provided in the housing and divides the inner space into a first space and a second space, the partition member being at least partially formed of a diaphragm;

an electrical signal output circuit which outputs an electrical signal based on vibrations of the diaphragm; and a first through-hole formed in the housing through which the first space communicates with an outer space of the housing and a second through-hole formed in the housing through which the second space communicates with the outer space, wherein a center-to-center distance between the first through-hole and the second through-hole is set within a range in which a sound pressure when using the diaphragm as a differential microphone is equal to or less than a sound pressure when using the diaphragm as a single microphone in all directions with respect to sound in an extraction target frequency band; and wherein the diaphragm is disposed closer to either the first through-hole or the second through-hole so that a distance between the diaphragm and the first through-hole is not equal to a distance between the diaphragm and the second through-hole.

23. The microphone unit as defined in claim 22, wherein the partition member is provided so that a medium that propagates sound waves does not move between the first space and the second space inside the housing.

24. The microphone unit as defined in claim 22, wherein the housing has a polyhedral external shape; and wherein the first through-hole and the second through-hole are formed in one face of the polyhedron.

25. The microphone unit as defined in claim 24, wherein the diaphragm is disposed so that a normal to the diaphragm is in parallel to the face.

26. The microphone unit as defined in claim 24, wherein the diaphragm is disposed so that a normal to the diaphragm perpendicularly intersects the face.

27. The microphone unit as defined in claim 24, wherein a center-to-center distance between the first through-hole and the second through-hole is 5.2 mm or less.

28. The microphone unit as defined in claim 22,
wherein the diaphragm is disposed so that the diaphragm does not overlap the first through-hole or the second through-hole.

29. The microphone unit as defined in claim 22,
wherein a center-to-center distance between the first through-hole and the second through-hole is 5.2 mm or less.

30. The microphone unit as defined in claim 22,
wherein the electrical signal output circuit is at least partially formed in the housing.

31. The microphone unit as defined in claim 22,
wherein the housing has a shielding structure which electromagnetically separates the inner space and the outer space of the housing.

32. The microphone unit as defined in claim 22,
wherein the diaphragm includes a vibrator having an SN ratio of about 60 dB or more.

33. A close-talking voice input device comprising the microphone unit as defined in claim 22.

34. The voice input device as defined in claim 33,
wherein the housing has a polyhedral external shape; and
wherein the first through-hole and the second through-hole are formed in one face of the polyhedron.

35. The voice input device as defined in claim 33,
wherein a center-to-center distance between the first through-hole and the second through-hole is 5.2 mm or less.

36. The voice input device as defined in claim 33,
wherein the diaphragm includes a vibrator having an SN ratio of about 60 dB or more.

37. The voice input device as defined in claim 33,
wherein the microphone unit is provided in the housing of a voice input device so that the first and second through-holes are disposed at different positions along a travel direction of a user's voice which is limited by a position of the housing in the voice input device.

38. The microphone unit as defined in claim 22,
wherein the microphone unit is provided in the housing of a voice input device so that the first and second through-holes are disposed at different positions along a travel direction of a user's voice which is limited by a position of the housing in the voice input device.

39. The microphone unit as defined in claim 22,
wherein a center-to-center distance between the first through-hole and the second through-hole is set so that a phase component intensity ratio of a user's voice is smaller than an amplitude component intensity ratio.

40. The microphone unit as defined in claim 22,
wherein a center-to-center distance between the first through-hole and the second through-hole is set so that a phase component intensity ratio of a noise is 0 dB or less.

* * * * *